US011376752B2

(12) United States Patent
Marinovich et al.

(10) Patent No.: US 11,376,752 B2
(45) Date of Patent: Jul. 5, 2022

(54) EMBEDDED BLADE CUTTERS AND BLADES FOR SAME

(71) Applicant: Pacific Handy Cutter, Inc., Irvine, CA (US)

(72) Inventors: Mark Marinovich, Rancho Santa Fe, CA (US); Kody Numedahl, Orange, CA (US); Joseph P. Garavaglia, Newport Beach, CA (US)

(73) Assignee: Pacific Handy Cutter, Inc., Irvine, CA (US)

( * ) Notice: Subject to any disclaimer, the term of this patent is extended or adjusted under 35 U.S.C. 154(b) by 0 days.

(21) Appl. No.: 16/460,427

(22) Filed: Jul. 2, 2019

(65) Prior Publication Data

US 2020/0114530 A1 Apr. 16, 2020

Related U.S. Application Data

(63) Continuation-in-part of application No. 29/600,319, filed on Apr. 11, 2017, now Pat. No. Des. 867,097, and a continuation-in-part of application No. 29/600,323, filed on Apr. 11, 2017, now Pat. No. Des. 867,847, and a continuation-in-part of application No. 15/821,787, filed on Nov. 23, 2017, now Pat. No.
(Continued)

(51) Int. Cl.

| | |
|---|---|
| ***B26B 3/08*** | (2006.01) |
| ***B25G 1/10*** | (2006.01) |
| ***A45F 5/02*** | (2006.01) |
| *B26B 29/02* | (2006.01) |

(52) U.S. Cl.
CPC ..... *B26B 3/08* (2013.01); *A45F 5/02* (2013.01); *B25G 1/102* (2013.01); *A45F 2200/0575* (2013.01); *B26B 29/02* (2013.01)

(58) Field of Classification Search
CPC ... B26B 3/08; B26B 29/02; A45F 5/02; A45F 2200/0575; B25G 1/102
USPC ..... 30/294, 346.6
See application file for complete search history.

(56) References Cited

U.S. PATENT DOCUMENTS 3,672,054 A * 6/1972 Kaufman ..... A61B 17/0467 30/294
3,673,687 A 7/1972 Phillips et al.
(Continued)

OTHER PUBLICATIONS

PCT/US20/40738, dated Oct. 28, 2020, International Search Report.
PCT/US20/40738, dated Oct. 28, 2020, Written Opinion.

*Primary Examiner* — Hwei-Siu C Payer
(74) *Attorney, Agent, or Firm* — Peter L. Holmes, Esq.

(57) ABSTRACT

A hand-held cutting tool includes a handle and a cutting head with an embedded tool having multiple operative surface portions, the embedded tool consisting of a single unitary metal piece, the multiple operative surface portions thereof including a cutting edge and a tape splitter portion, the embedded tool being molded or otherwise secured within the cutting head such that the tape splitter portion distally extends from the cutting head and a portion of the cutting edge is exposed. The embedded tool includes a top flat surface section which is part of and defined by an uppermost structural reinforcing portion of the single unitary metal piece; and the tape splitter portion is recessed in relation to the uppermost structural reinforcing portion relative to the cutting edge of the blade.

23 Claims, 23 Drawing Sheets

Related U.S. Application Data

10,493,645, and a continuation-in-part of application No. 29/695,228, filed on Jun. 17, 2019.

(56) References Cited

U.S. PATENT DOCUMENTS 4,858,323 A * 8/1989 Iten ..... B26B 21/56 30/346.6
D323,967 S 2/1992 Talbot
5,724,738 A * 3/1998 Ballarini ..... B43M 7/002 30/294
6,195,896 B1 3/2001 Ireland
6,493,945 B1 * 12/2002 DeRosa ..... B26B 27/00 30/286
D575,613 S 8/2008 Jennings
D673,440 S 1/2013 Kempker et al.
D714,611 S 10/2014 Yu Chen
D721,564 S 1/2015 Purnomohadi
D784,107 S 4/2017 Chen
D801,148 S 10/2017 Yu Chen
D802,394 S 11/2017 Yu Chen
D817,142 S 5/2018 Rohrbach et al.
D817,143 S 5/2018 Rohrbach
9,969,091 B2 5/2018 Jacobs
D837,626 S 1/2019 Rohrbach
10,350,775 B2 7/2019 Jacobs
D863,924 S 10/2019 Nguyen
10,442,093 B2 10/2019 Jacobs et al.
D867,097 S 11/2019 Marinovich et al.
D867,847 S 11/2019 Marinovich et al.
10,493,645 B2 * 12/2019 Marinovich ..... B26B 29/02
10,974,406 B2 4/2021 Jacobs
2007/0245571 A1 10/2007 Pearson
2007/0245572 A1 * 10/2007 Ireland ..... B26B 27/005 30/294
2014/0041239 A1 2/2014 Scimone et al.
2014/0345146 A1 * 11/2014 Schekalla ..... B26B 3/08 30/169
2015/0298330 A1 10/2015 Yu Chen
2017/0197320 A1 * 7/2017 Chen ..... B26B 11/006
2017/0368698 A1 * 12/2017 Huang ..... B26B 29/02
2018/0085932 A1 * 3/2018 Yu Chen ..... B26B 11/006
2018/0229380 A1 8/2018 Gringer
2018/0257250 A1 9/2018 Jacobs
2020/0030997 A1 1/2020 Jacobs et al.
2020/0114530 A1 * 4/2020 Marinovich ..... A45F 5/02

* cited by examiner

EMBEDDED BLADE CUTTERS AND BLADES FOR SAME

CROSS-REFERENCE TO RELATED APPLICATIONS

This application is a continuation-in-part of U.S. Design patent application Ser. No. 29/600,319, entitled "Embedded Blade Cutter" filed on Apr. 11, 2017 now U.S. Pat. No. D867,097, a continuation-in-part of U.S. Design patent application Ser. No. 29/600,323, entitled "Embedded Blade Cutter" filed on Apr. 11, 2017 now U.S. Pat. No. D867,847, a continuation-in-part of U.S. Utility patent application Ser. No. 15/821,787, entitled "Embedded Blade Cutters" filed on Nov. 23, 2017 now U.S. Pat. No. 10,493,645, and a continuation-in-part of U.S. Design patent application Ser. No. 29/695,228, entitled "Embedded Blade Cutter" filed on Jun. 17, 2019 now U.S. Pat. No. D897,807 which are hereby incorporated by reference.

TECHNICAL FIELD

The present invention relates generally to cutters and cutter apparatuses, in particular, hand-held cutting tools including at least one cutting head with an embedded blade, and blades for embedded blade cutters.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade change, or blade storage.

It is known to provide a safety cutter with a guard (or guide) located a short distance from and facing a side of the cutting blade. See e.g., U.S. Pat. Nos. 5,386,632, 6,314,646 B1, D544,774 S, and 7,987,602 B2, which are hereby incorporated by reference.

It would be useful to be able to provide a hand-held cutting tool with a cutting head that has improved structural integrity, durability or strength and/or an embedded blade for such a hand-held cutting tool.

It would be useful to be able to provide such a hand-held cutting tool in which the embedded blade has multiple operative surface portions including a cutting edge and a tape splitter portion.

It would be useful to be able to provide such a hand-held cutting tool in which the embedded blade consists of a single unitary piece made of metal or other material(s).

It would be useful to be able to provide a hand-held cutting tool in which the cutting head includes or is provided with surfaces or other structures providing visual indicators of cutting edge location and/or orientation in relation to a cutting channel of the tool that receives a workpiece or other object to be cut.

It would be useful to be able to provide a hand-held cutting tool with a mechanism or device that facilitates one or more of improved, advantageous, or otherwise desirable cutter qualities, performance and/or manufacturability.

SUMMARY OF THE INVENTION

In an example embodiment, a blade for a hand-held cutting tool includes a main portion including, at a bottom side thereof, a cutting edge, the main portion being planar and substantially uniform in thickness between front and back sides thereof, the main portion including a periphery boundary extending from opposite ends of the cutting edge, the periphery boundary being defined by a plurality of contiguous side surfaces including flat surfaces and curved surfaces, the flat surfaces including a first group of flat surface sections all of which are parallel or orthogonal to the cutting edge and none of which are adjacent to others of the first group, the flat surfaces including a second group of flat surface sections all of which are at a 45° angle in relation to the cutting edge and none of which are adjacent to others of the second group, the curved surfaces including a tape splitter portion at a top corner of the main portion.

In an example embodiment, a hand-held cutting tool includes a handle and a cutting head with an embedded tool having multiple operative surface portions, the cutting head being connected to the handle, the embedded tool consisting of a single unitary metal piece, the multiple operative surface portions thereof including a cutting edge and a tape splitter portion at an opposite side of the metal piece from the cutting edge, the cutting head including a distal opening and a channel sized to receive a workpiece therein, the embedded tool being molded or otherwise secured within the cutting head such that the tape splitter portion extends from the distal opening and a portion of the cutting edge extends from the cutting head and is located and exposed within the channel for cutting a workpiece that is advanced into the channel and brought into contact with the cutting edge; wherein the embedded tool includes a top flat surface section which is part of and defined by an uppermost structural reinforcing portion of the single unitary metal piece; and wherein the tape splitter portion is recessed in relation to the uppermost structural reinforcing portion relative to the cutting edge of the blade.

In an example embodiment, a hand-held cutting tool includes a handle and a cutting head with an embedded tool including a cutting edge, the cutting head being connected to the handle, the cutting head including a channel sized to receive a workpiece therein, the embedded tool being molded or otherwise secured within the cutting head such that a portion of the cutting edge extends from the cutting head and is located and exposed within the channel for cutting a workpiece that is advanced into the channel and brought into contact with the cutting edge; wherein the cutting head includes a hook portion at an opposite side of the channel from the handle, the hook portion including a visually distinct narrow surface section coaligned with the cutting edge of the blade.

BRIEF DESCRIPTION OF THE DRAWINGS

FIG. 41 is an isometric perspective view of another example embodiment of a cutter apparatus;

FIGS. 42-66 are right side, front, left side, back and top views, respectively, of the cutter apparatus of FIG. 41;

FIG. 47 is a cross-sectional view of the cutter apparatus along lines F-F of FIG. 44 showing an embedded tool consisting of a single unitary metal piece secured within a cutting head;

FIG. 48 is a cross-sectional view of the cutter apparatus along lines A-A of FIG. 44 showing generally U-shaped gripping ridges at left and right distal side portions of the handle;

FIG. 49 is a cross-sectional view of the cutter apparatus along lines B-B of FIG. 44 showing side wall surfaces defining recesses at opposite (the left and right) sides of the handle;

FIG. 50 is a cross-sectional view of the cutter apparatus along lines C-C of FIG. 44 also showing side wall surfaces defining recesses at opposite (the left and right) sides of the handle;

FIG. 51 is a cross-sectional magnified view of the portion of FIG. 48 denoted DETAIL D showing portions of the U-shaped gripping ridges in profile;

FIG. 52 is a cross-sectional view showing in isolation the portion of FIG. 51 denoted DETAIL E;

FIG. 53 is a cross-sectional view of the cutter apparatus along lines K-K of FIG. 42 showing the embedded tool consisting of a single unitary metal piece secured within a cutting head;

FIG. 54 is a magnified view of DETAIL G (of FIG. 44) showing the U-shaped gripping ridges at the left side of the cutter apparatus;

FIG. 55 is a bottom view of the cutter apparatus of FIG. 41;

FIG. 57 is an isometric perspective view of an example embedded tool or blade consisting of a single unitary metal piece;

FIG. 58 is an enlarged plan view of the embedded tool or blade of FIG. 57 showing a cutting edge and a periphery boundary extending from opposite ends of the cutting edge, the periphery boundary being defined by a plurality of contiguous side surfaces including flat surface sections and curved surface sections;

FIG. 59 is left side view of the embedded tool or blade as shown in FIG. 58; and FIG. 60 is a magnified view of DETAIL A (of FIG. 59) showing the sharpened cutting edge in profile.

DISCLOSURE OF INVENTION

Figure 3:
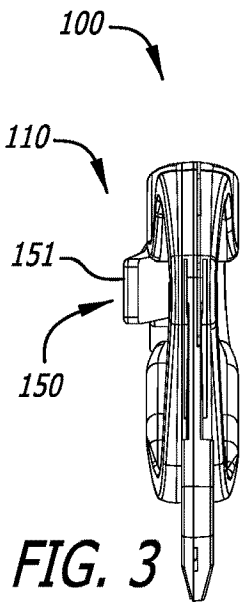
FIGS. 2-6 are right side, front, left side, back and top views, respectively, of the cutter apparatus of FIG. 1.
Figure 1:
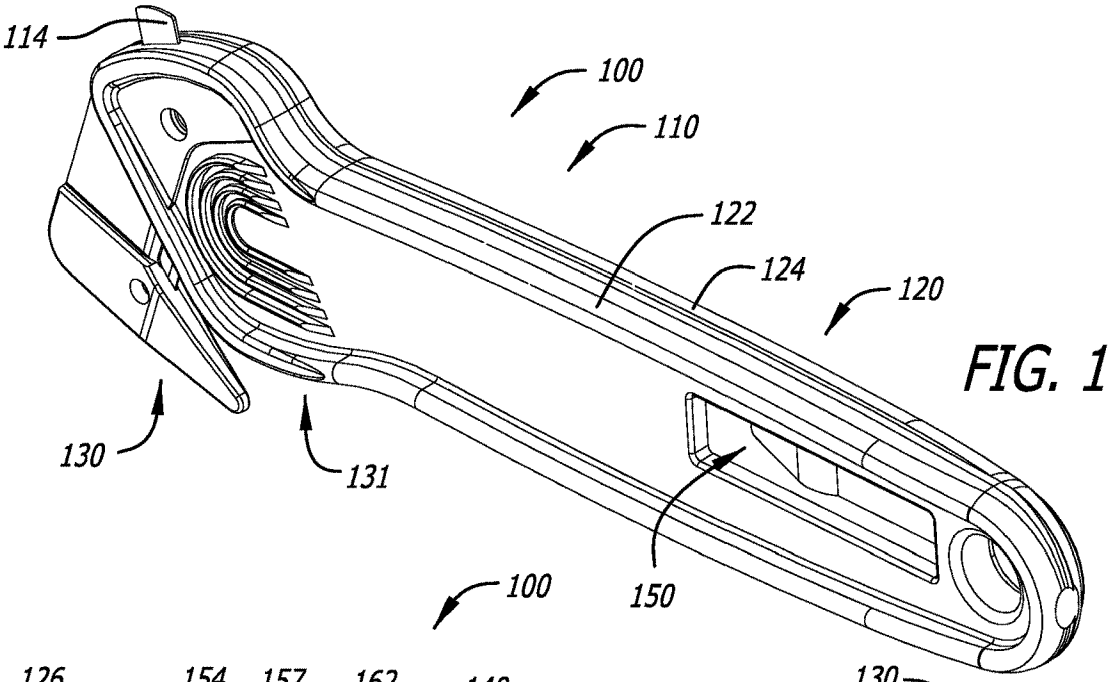
FIG. 1 is an isometric perspective view of an example embodiment of a cutter apparatus.
Figure 2:
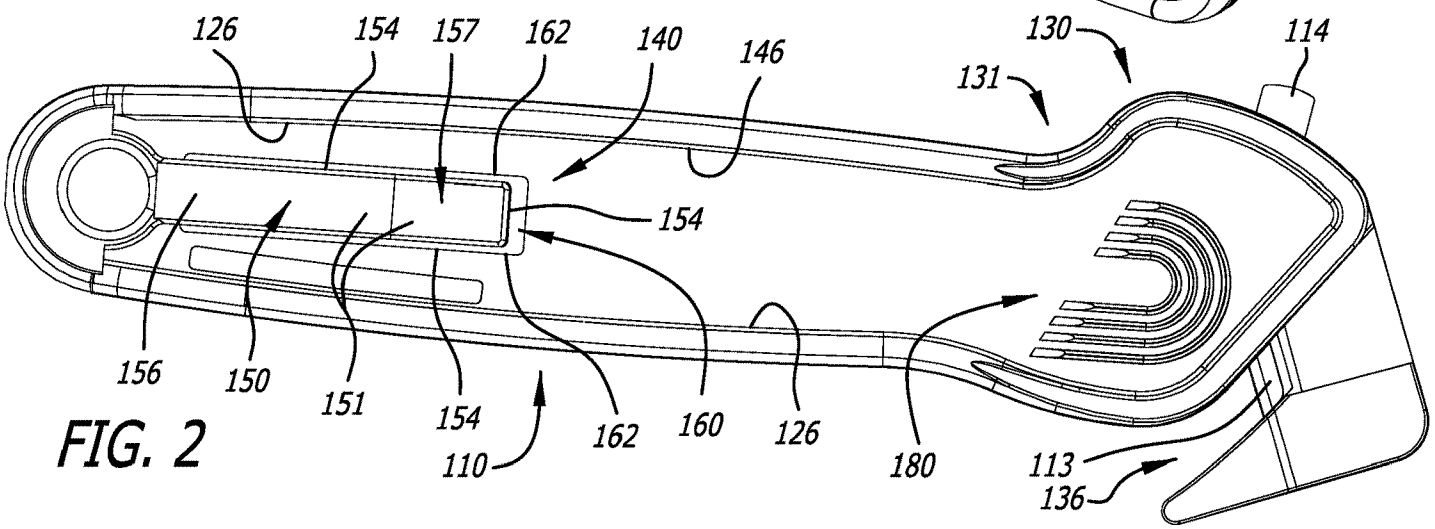
Figure 7:
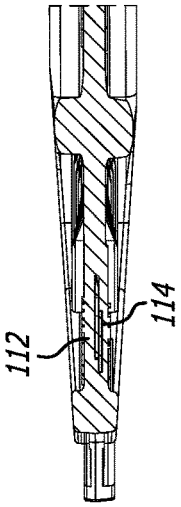
FIG. 7 is a cross-sectional view of the cutter apparatus along lines F-F of FIG. 4 showing embedded blade and tape splitter elements secured within a cutting head.
Figure 6:
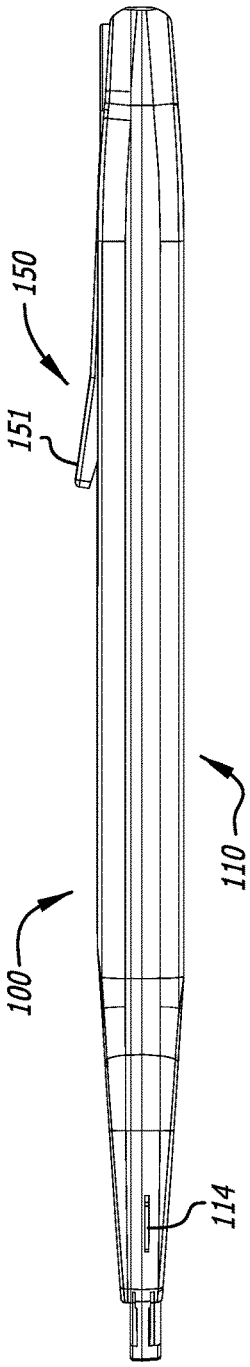
Figure 5:
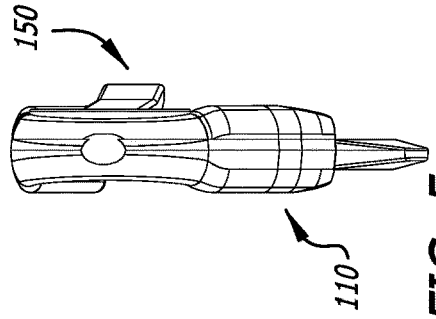
Figure 4:
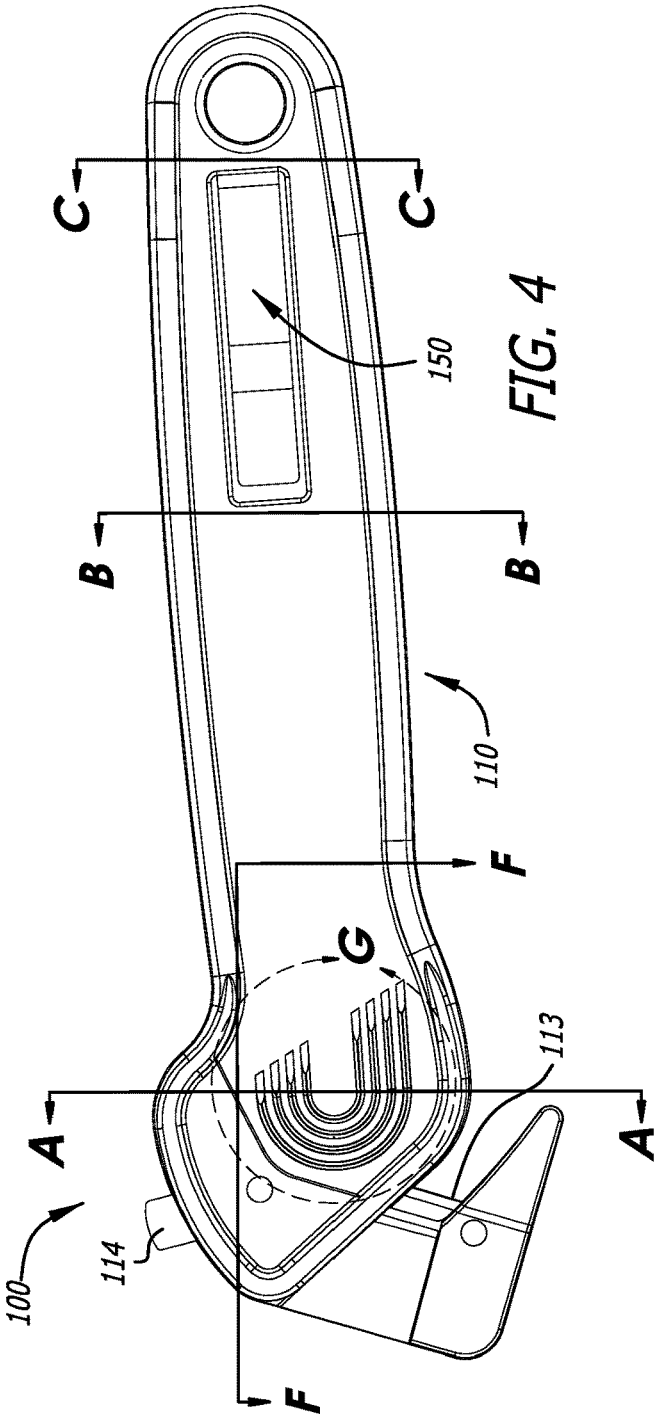
Figure 9:
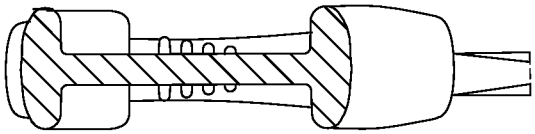
FIG. 9 is a cross-sectional view of the cutter apparatus along lines B-B of FIG. 4 showing side wall surfaces defining recesses at opposite (the left and right) sides of the handle.
Figure 12:
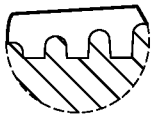
FIG. 12 is a cross-sectional view showing in isolation the portion of FIG. 11 denoted DETAIL E.
Figure 11:
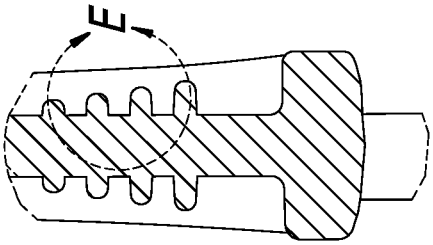
FIG. 11 is a cross-sectional magnified view of the portion of FIG. 8 denoted DETAIL D showing portions of the U-shaped gripping ridges in profile.
Figure 8:
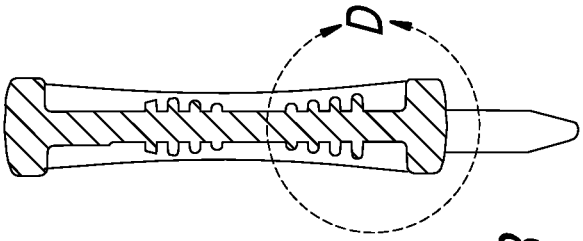
FIG. 8 is a cross-sectional view of the cutter apparatus along lines A-A of FIG. 4 showing generally U-shaped gripping ridges at left and right distal side portions of the handle.
Figure 10:
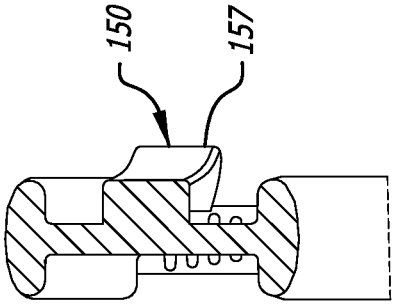
FIG. 10 is a cross-sectional view of the cutter apparatus along lines C-C of FIG. 4 showing an interconnection support structure and a clip extending therefrom.
Figure 13:
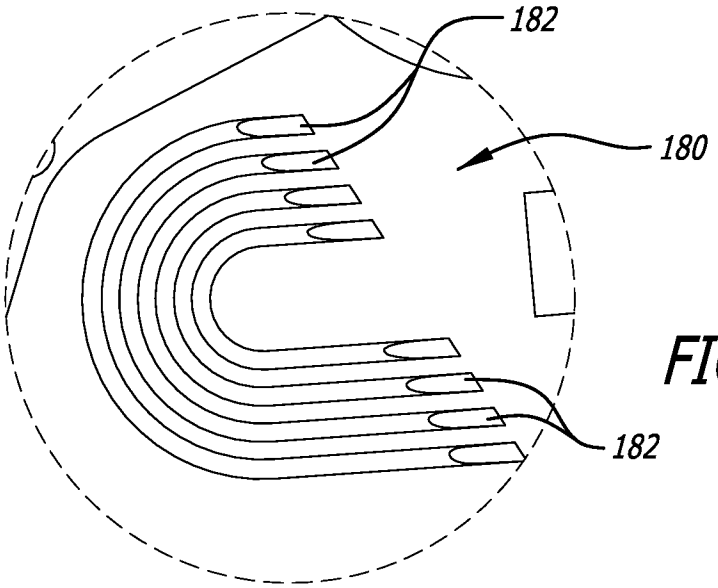
FIG. 13 is a magnified view of DETAIL G (of FIG. 4) showing the U-shaped gripping ridges at the left side of the cutter apparatus.
Figure 14:
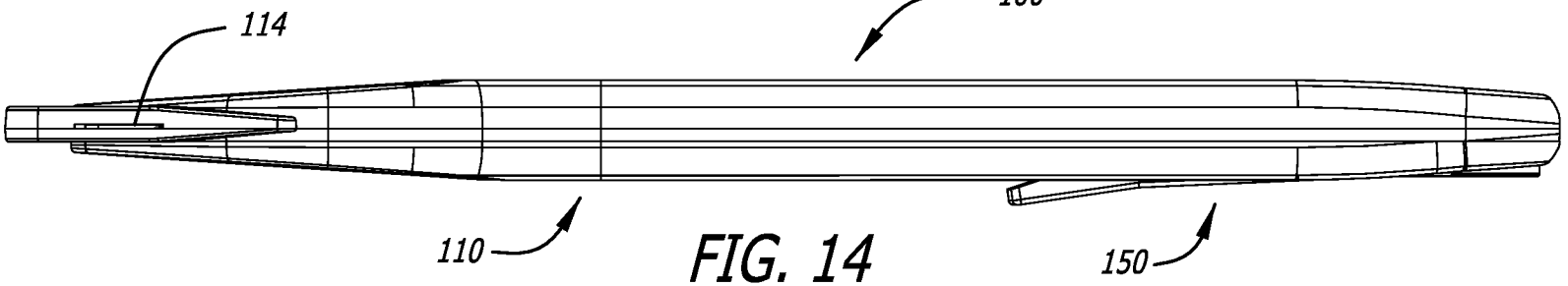
FIG. 14 is a bottom view of the cutter apparatus of FIG. 1.
Figure 15:
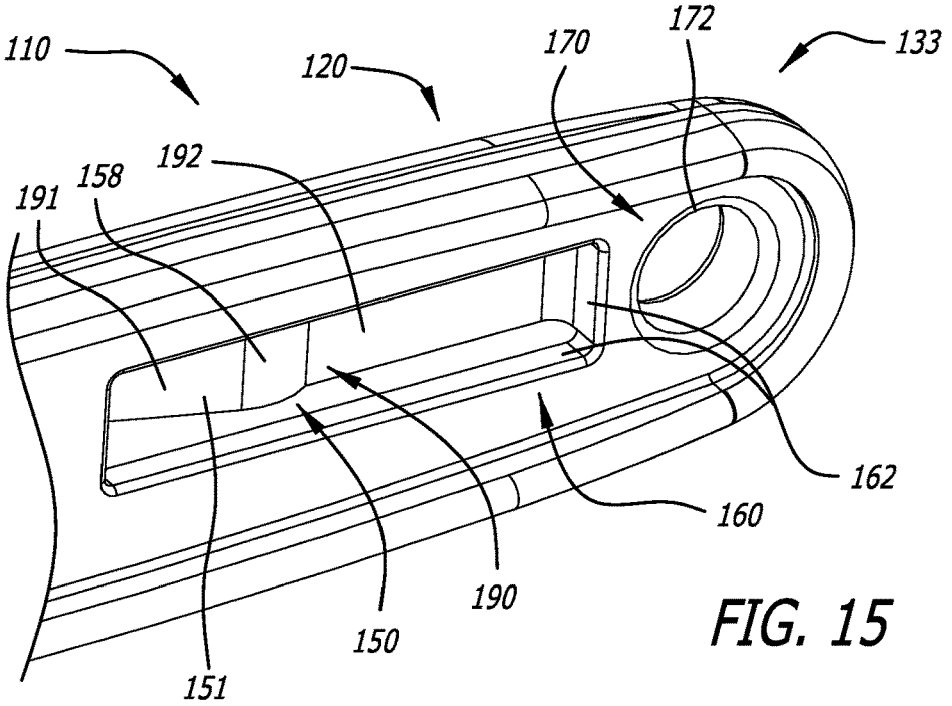
FIG. 15 is an isometric perspective view of the proximal end of the handle showing an opening of the handle and (facing the opening) a clip connected at a base portion thereof to the handle.
Figure 16:
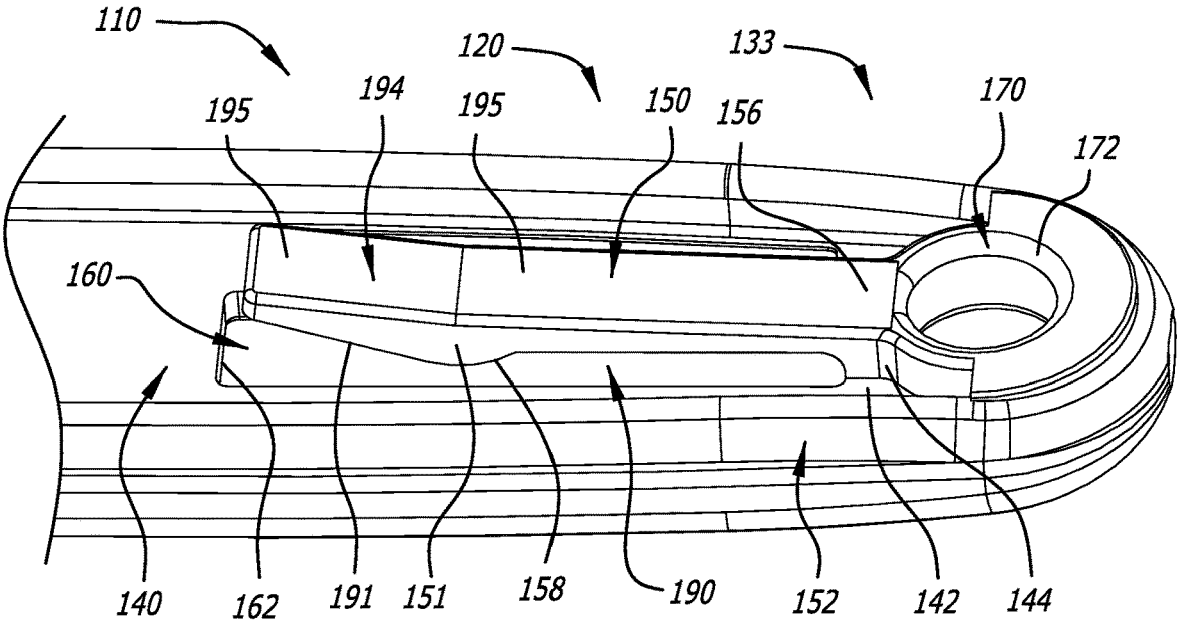
FIG. 16 is another isometric perspective view of the proximal end of the handle showing a recess of the handle and a connection interface at which the clip is connected to the handle, the connection interface including a bottom portion of the recess and a side wall portion of the recess (periphery portion of an annular or ring-like wall structure)
Figure 17A:
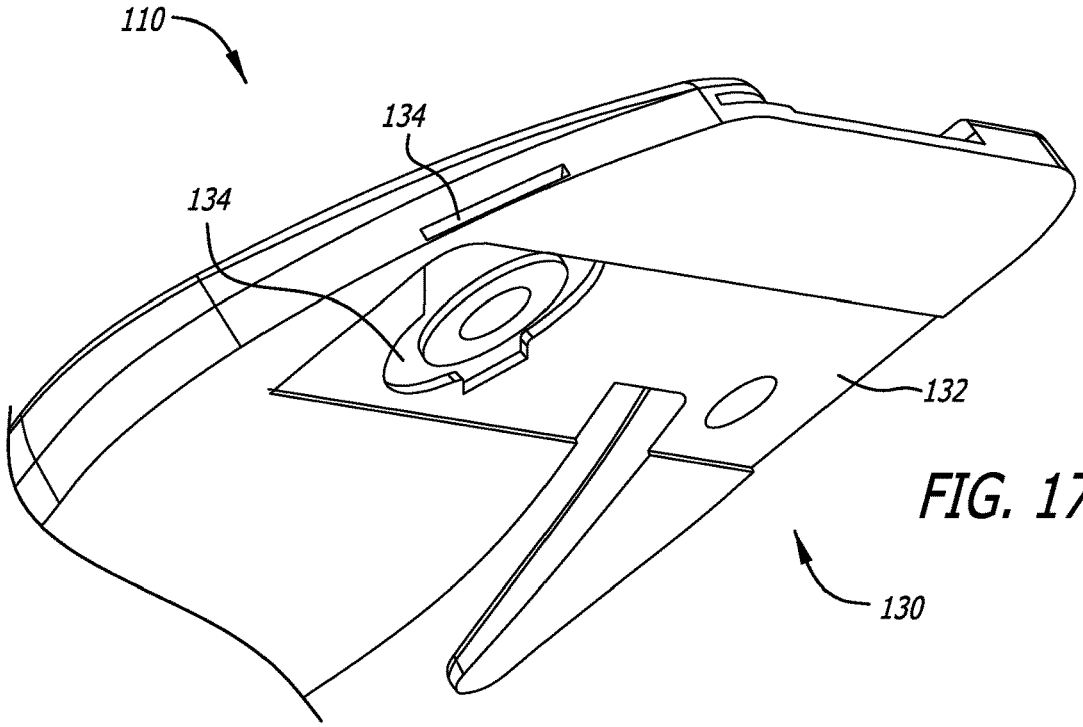
FIG. 17A is a cross-sectional isometric perspective view of the distal end of the cutter apparatus showing a blade receiving recess/channel and (adjacent thereto) a tape splitter recess/channel—the blade and the tape splitter are not shown in this view.
Figure 17B:
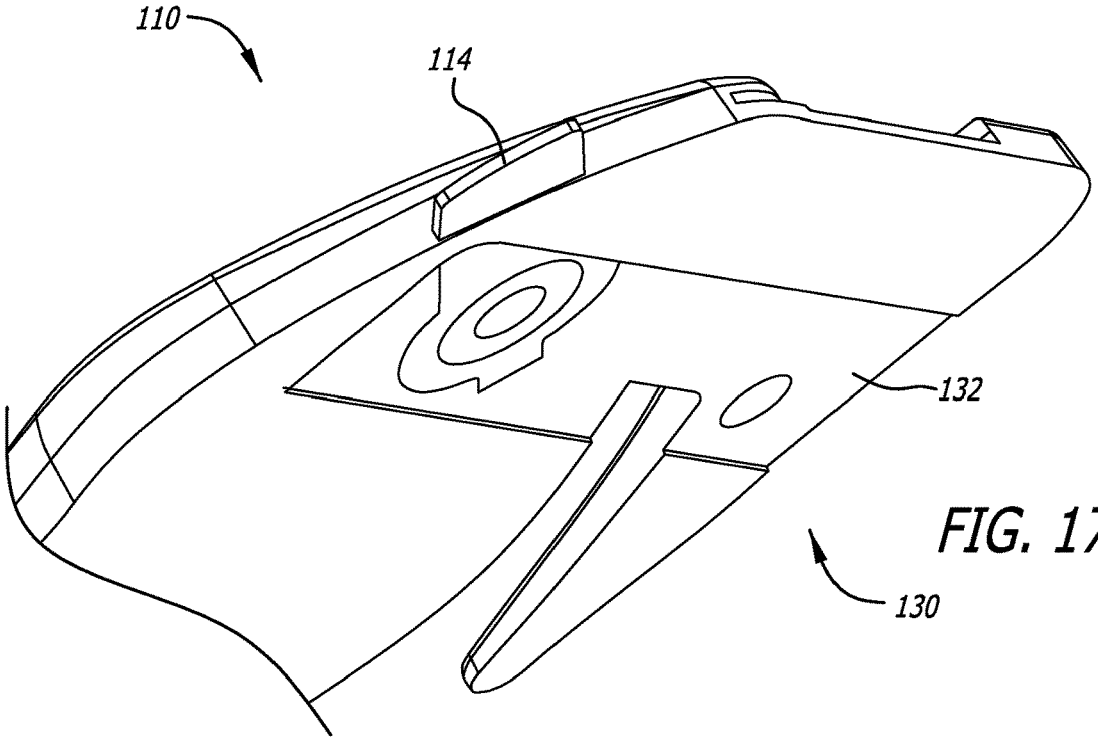
FIG. 17B shows the cross-sectional isometric perspective view of FIG. 17A with the tape splitter positioned within the tape splitter recess/channel and extending from an opening in the cutting head (defined by the tape splitter recess/channel)
Figure 18A:
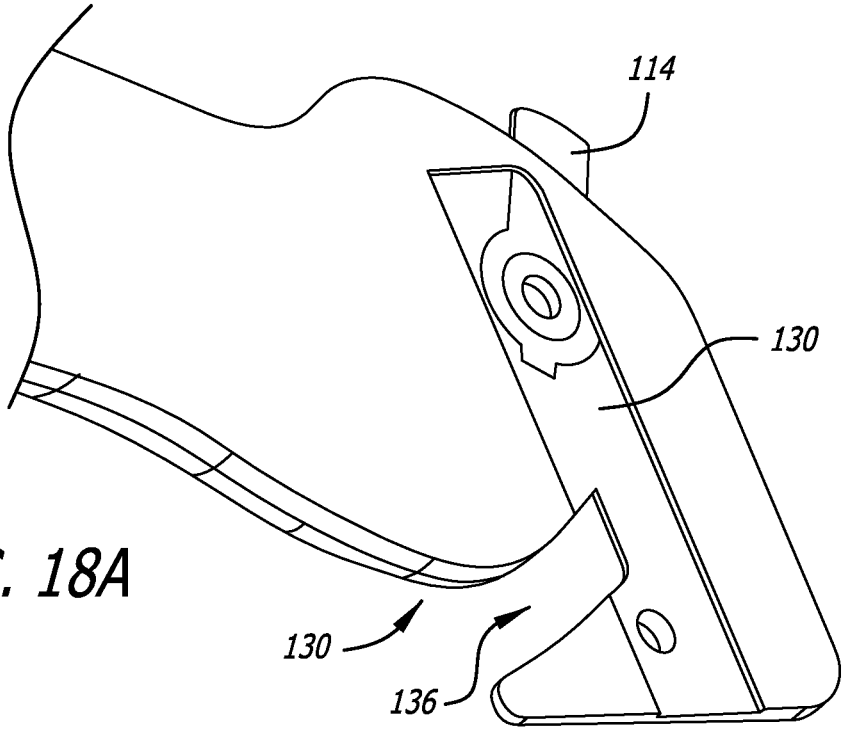
FIG. 18A is another cross-sectional isometric perspective view of the distal end of the cutter apparatus showing the blade receiving recess/channel and the tape splitter secured within the tape splitter recess/channel—the blade is not shown in this view (to also show a cutting channel that extends into the blade receiving recess/channel to expose the cutting portion of a blade secured within the blade receiving recess/channel)
Figure 18B:
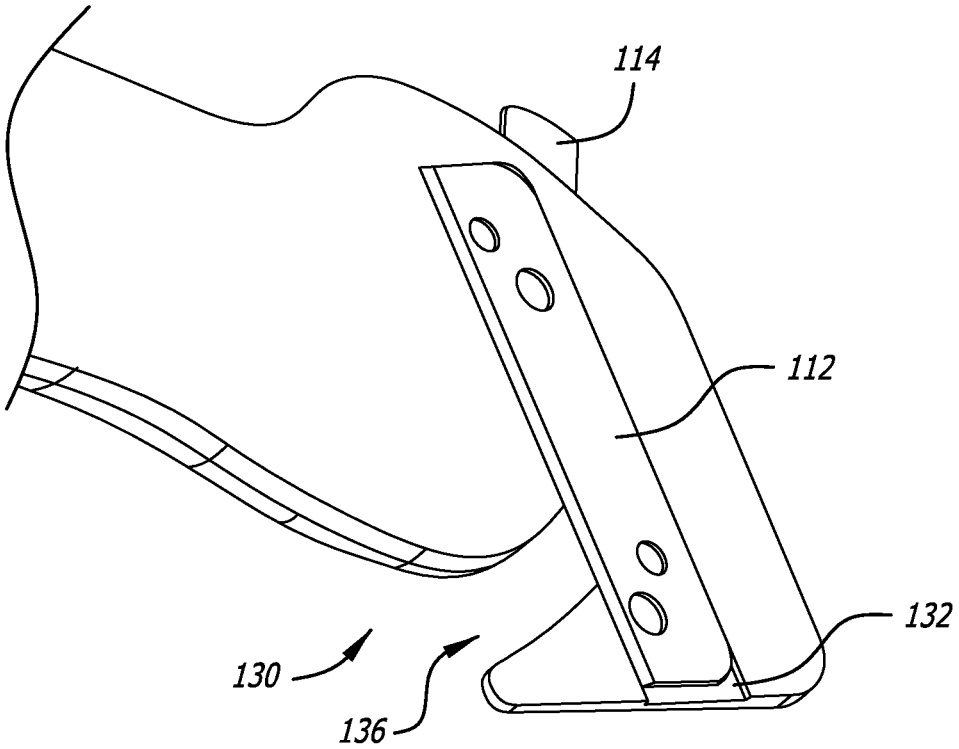
FIG. 18B shows the cross-sectional isometric perspective view of FIG. 18A with the blade positioned within the blade receiving recess/channel.
Figure 19:
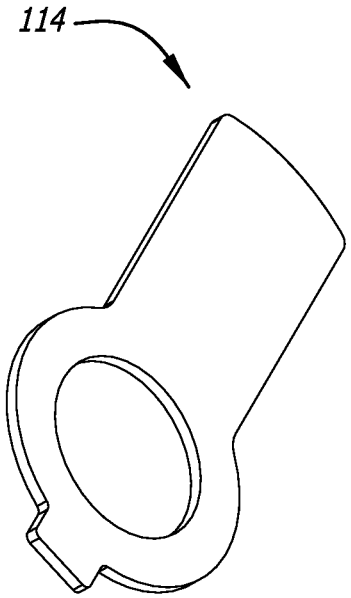
FIG. 19 is an isometric perspective view of an example tape splitter including a keyed end portion that interfits with the tape splitter recess/channel.
Figure 20:
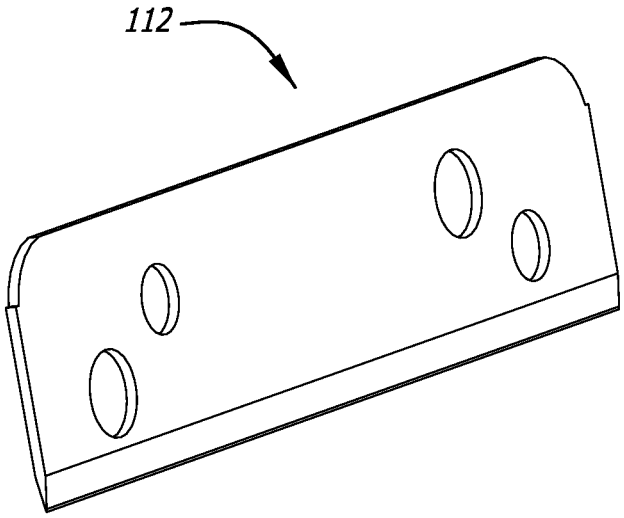
FIG. 20 is an isometric perspective view of an example blade including openings that receive posts or other structures for securing the blade within the blade receiving recess/channel.
Figure 20A:
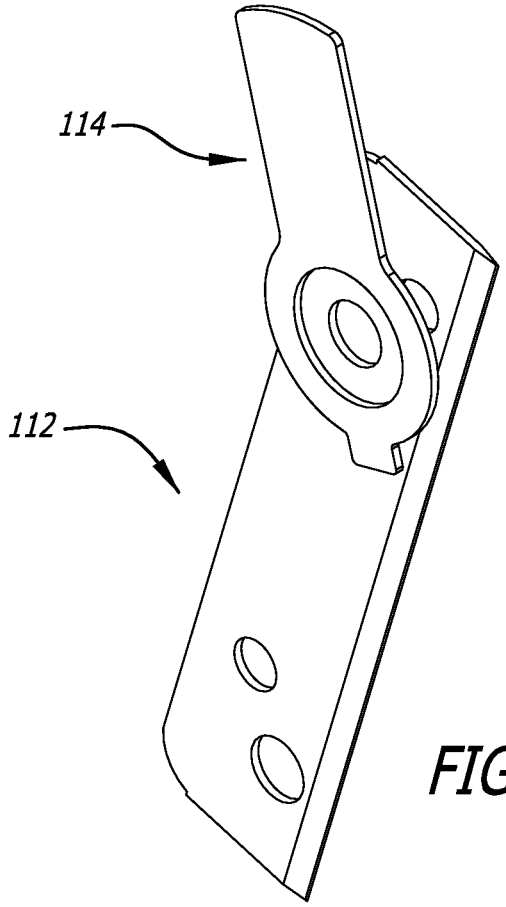
FIG. 20A is an isometric perspective view showing in isolation the tape splitter and blade adjacent to each other when secured within the tape splitter recess/channel and the blade receiving recess/channel, respectively.
Figure 21:
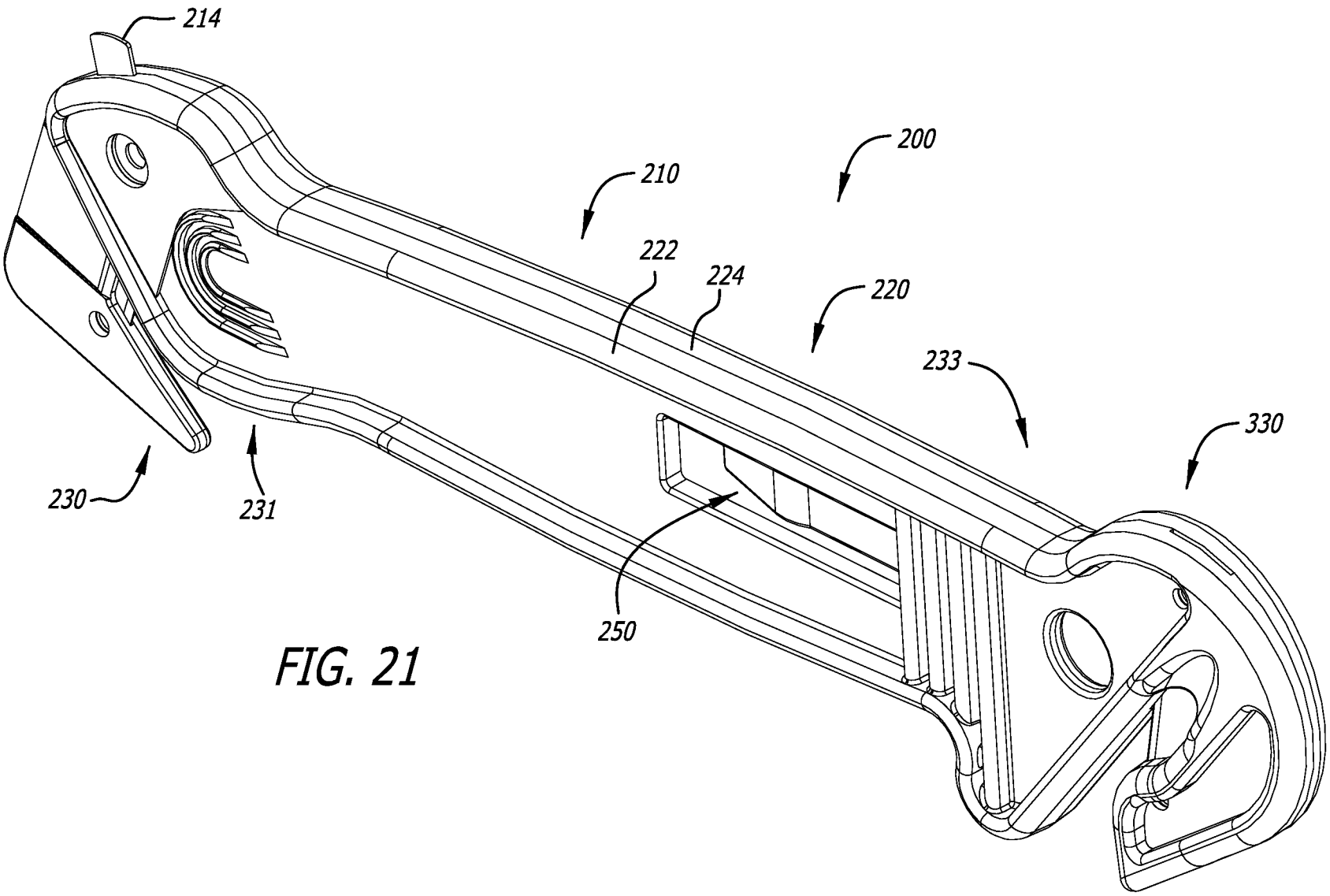
FIG. 21 is an isometric perspective view of another example embodiment of a cutter apparatus.
Figure 23:
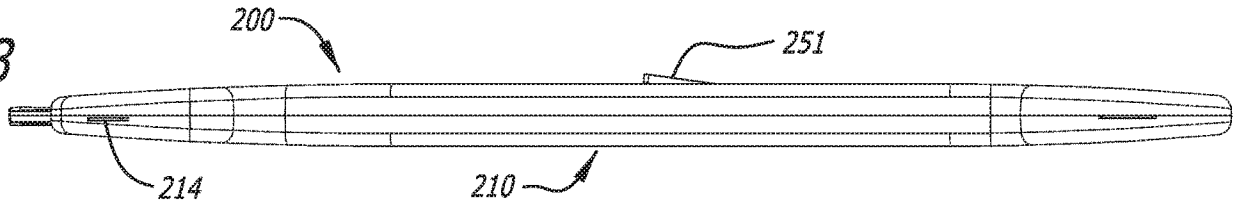
FIGS. 22-27 are left side, top, bottom, front, back and right side views, respectively, of the cutter apparatus of FIG. 21.

Referring to FIGS. 1-20A, in an example embodiment, a hand-held cutting tool (or cutting apparatus) 100 includes a housing 110 (e.g., shaped to be hand-held as shown), an embedded blade (or blade) 112 and a tape splitter (or tape splitter component) 114. The housing 110 includes a handle (or handle portion) 120, and has a left side 122 and a right side 124 at opposite sides of the blade 112 and the tape splitter 114. The housing 110 includes a cutting head (portion) 130 at a distal end 131 of the handle 120. As shown in FIGS. 2 and 16, the handle 120 includes a recess 140 at a side portion thereof (e.g., a recessed side portion/area of the handle as shown). The housing 110 also includes a clip 150 that is connected to (or integrally formed with) the handle 120, the clip 150 including a resilient member 151 extending generally lengthwise along the handle (e.g., shaped/configured as shown). The housing 110 can be formed of various materials, for example, a moldable composite material (e.g., a material: glass-filled polymer or glass-filled plastic (GF), polytetrafluoroethylene (PTFE) nylon), and by various processes (e.g., insert molded). For example, the housing 110 can be molded or otherwise formed around the blade 112 and the tape splitter 114 such that the left and right sides of the housing are (permanently) positioned in relation to each other with the blade 112 and the tape splitter 114 secured therebetween and adjacent to each other (FIG. 7). The term "embedded blade" can refer (for example) to a blade that is secured within or to or otherwise connected to a cutting head and/or handle of a hand-held cutting tool. The blade 112 can be formed of various materials, for example, steel (e.g., SAE 1095 steel heat treated to HRC 58-60). The tape splitter 114 can be formed of various materials, for example, steel (or a high strength plastic).

Referring to FIGS. 17A, 17B, 18A and 18B, the cutting head 130 includes the blade 112 secured within a blade receiving recess/channel 132, and the tape splitter 114 secured within a tape splitter (keyed) recess/channel 134 adjacent to the blade receiving recess/channel 132. The cutting head 130 includes a (cutting) channel 136 formed as shown and extending into the blade receiving recess/channel 132. When secured within the blade receiving recess/channel 132, a cutting portion 113 of the blade 112 is located (e.g., visible/exposed) within the channel 136.

Referring to FIG. 16, the clip 150 is only connected to or in contact with the handle 120 at an interconnection interface 152 that includes a bottom (surface/)portion 142 of the recess 140 and a side wall (surface/)portion 144 of the recess 140. The interconnection interface, at the bottom and side wall portions of the recess, can be described as approximately "right angled". Referring to FIGS. 15 and 16, the bottom (surface/)portion 142 of the recess 140 includes an opening 160 facing the clip 150 and provided through the handle 120 as shown. Referring additionally to FIG. 2, the handle 120 includes surfaces 162 that define the opening 160 including a periphery boundary of the opening (e.g., at a bottom surface of the recess) circumscribing or generally being co-aligned with side surfaces(/portions) 154 of the clip 150 though, in this example embodiment, not circumscribing a base (or base portion) 156 of the clip 150. The recess 140 has a periphery (or boundary) 146 defined (at least in part) by side wall surfaces(/portions) 126 of the handle 120 and/or the (contiguous) side surfaces(/portions) 154 of the clip 150. Accordingly, the clip 150 is connected at its base (portion) 156 to the handle at a location within (e.g., interconnection location or juncture of) the recess 140. The clip 150 is only connected to or in contact with the handle 120 at the location independent of whether the resilient member 151 of the clip 150 flexes or otherwise repositions in relation to the base (portion) 156 of the clip 150.

Thus, in an example embodiment, a hand-held cutting tool includes a handle configured for gripping by a hand, the handle including a recess at a side portion thereof, a cutting head at a distal end of the handle; and a clip (integrally formed with or) connected at a base portion thereof to the handle within the recess, the clip only being connected to or in contact with the handle at an interconnection interface that includes a bottom portion of the recess and a side wall portion of the recess. In example embodiments, the cutting head has a blade (an embedded blade) that is secured within or to or otherwise connected to the cutting head, a cutting portion thereof (of the blade) being located (e.g., visible/exposed) within a channel (or other opening, recess or the like) of the cutting head. In example embodiments, the cutting head provides (embodies) at least part of or includes an embedded blade cutter.

Referring to FIGS. 15 and 16, the handle 120 includes (and the recess 140 is in part defined by) an annular or ring-like wall structure 170 at a proximal end 133 of the handle, and the clip 150 (at its base portion 156) is (integrally formed with or) connected to a periphery portion of the wall structure at the side wall (surface/)portion 144 of the recess 140 (providing a side wall portion of the interconnection interface 152). The annular or ring-like wall structure 170 also defines, at its interior, an opening 172 as shown (e.g., a lanyard or hanger hole opening).

The clip 150 includes an angled end portion 157 (see also FIG. 10) at an opposite end of the clip in relation to the base portion 156, and the handle 120 includes (or is provided with) (concentric/equidistantly nested) generally U-shaped (raised) gripping ridges 180 (see also FIGS. 8, 9, 11 and 12) having beveled portions(surfaces) 182 at the ends of each ridge (FIG. 13), the beveled portions 182 facing the angled end portion 157 of the clip 150 (FIG. 2).

Referring to FIGS. 15 and 16, the clip 150 includes an inwardly facing engagement portion 158 (for securing/clipping the tool to a pocket), e.g., a protrusion shaped/configured as shown, that is wider laterally in relation to the handle 120 than at either the base portion 156 or the angled end portion 157 of the clip 150. The clip 150 includes two generally planar surfaces 191, 192 at and defining different (non-adjacent) portions of an inward facing side 190 of the clip 150, the planar surfaces not being parallel in relation to each other (e.g., not located within respective planes that are parallel to each other). The engagement portion 158 transitions (curves) between the two generally planar surfaces 191, 192 (e.g., as shown). The clip 150 also includes two generally planar surfaces 195, 196 at and defining different (adjacent and contiguous) portions of an outward facing side 194 of the clip 150, the planar surfaces not being parallel in relation to each other (e.g., not located within respective planes that are parallel to each other).

Figure 27:
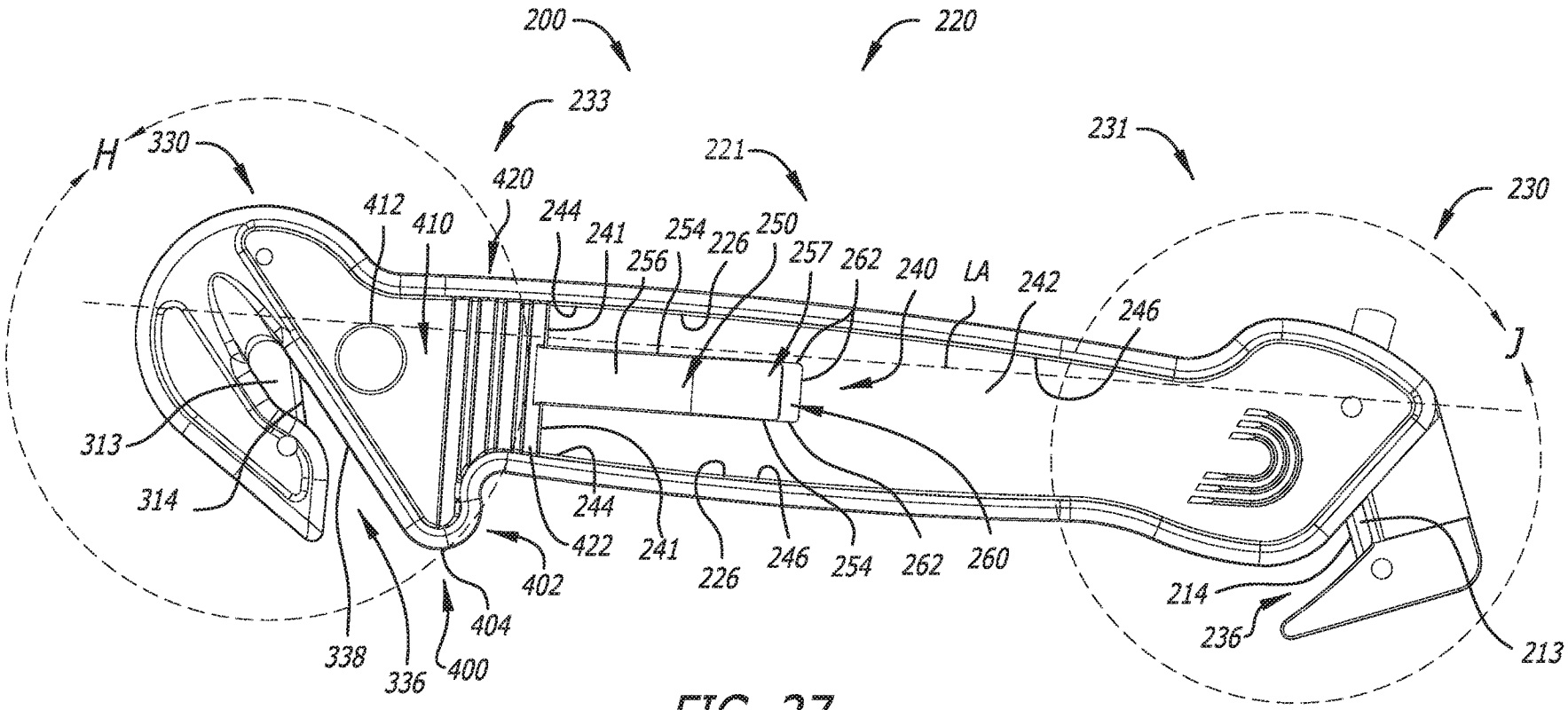
Figure 33:
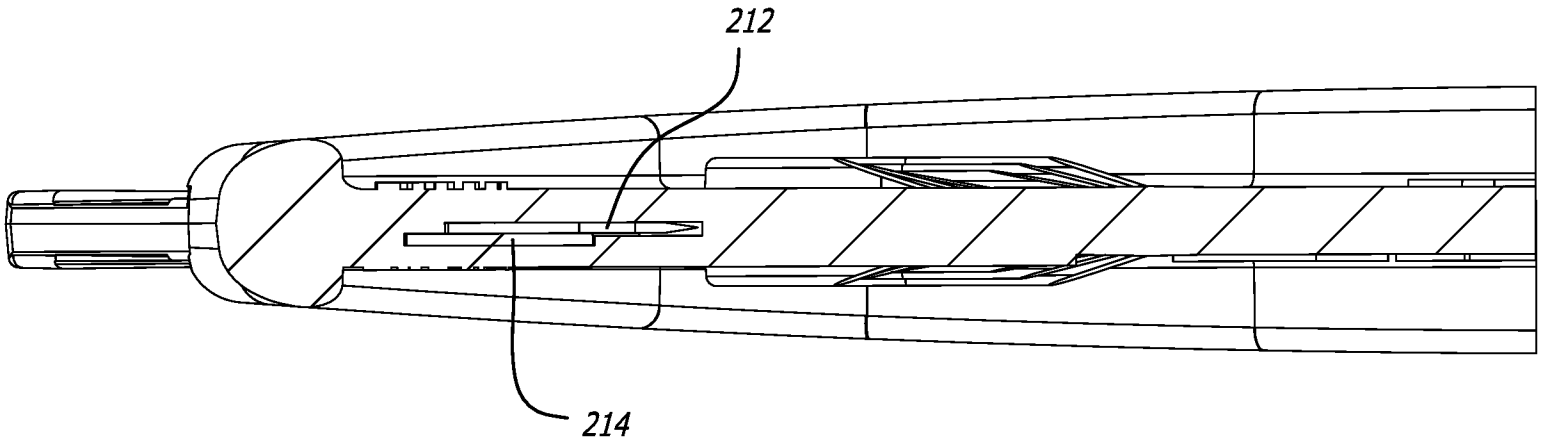
FIG. 33 is a cross-sectional view of the cutter apparatus along lines F-F of FIG. 22 showing embedded blade and tape splitter elements secured within a cutting head that includes a box cutter.
Figure 35:
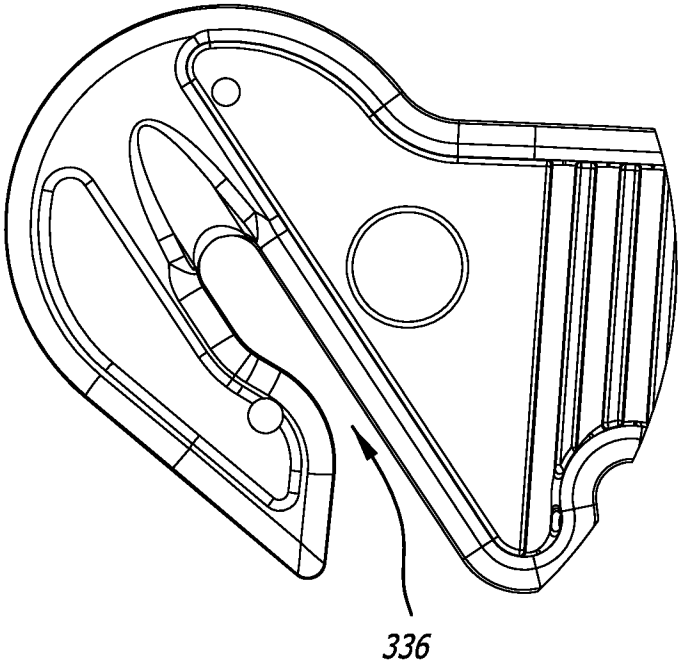
FIG. 35 is a magnified view of DETAIL H (of FIG. 27) showing an additional cutting head (of the cutter apparatus) that includes a film cutter.
Figure 34:
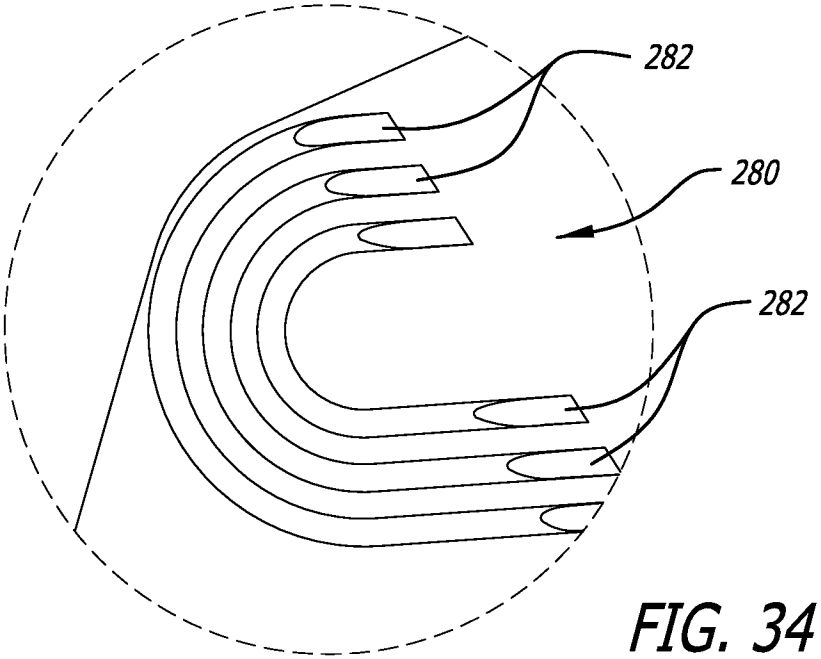
FIG. 34 is a magnified view of DETAIL G (of FIG. 22) showing the U-shaped gripping ridges at the left side of the cutter apparatus.
Figure 37:
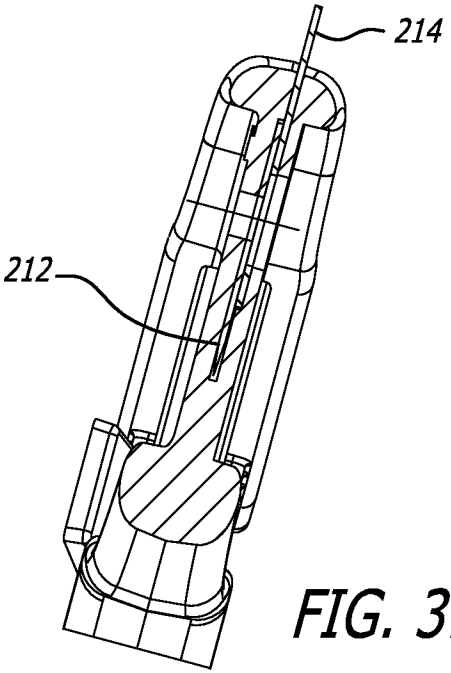
FIG. 37 is a cross-sectional magnified view along lines K-K of FIG. 36.
Figure 36:
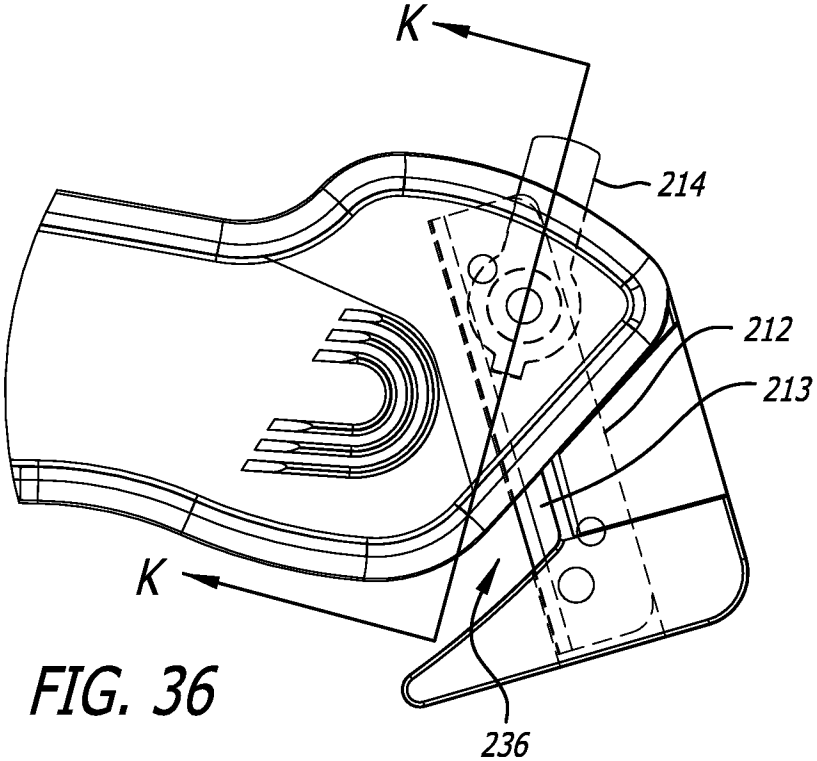
FIG. 36 is a magnified view of DETAIL J (of FIG. 27) showing (and interiorly, in broken lines) the tape splitter and the blade of the box cutter.
Figure 38A:
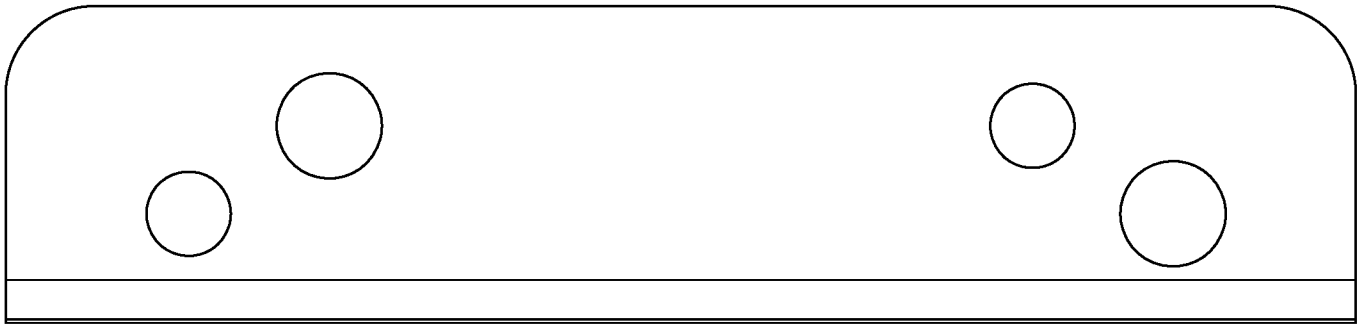
FIGS. 38A and 38B are side and end views, respectively, of an example blade (of one or more of the cutting heads) including openings that receive posts or other structures for securing the blade within a blade receiving recess/channel.
Figure 38C:
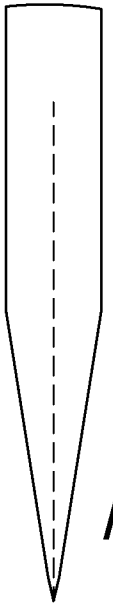
FIG. 38C is a magnified view of DETAIL A (of FIG. 38B)
Figure 38B:
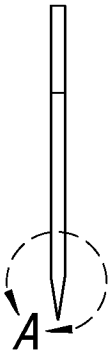

Referring to FIGS. 21-40, in another example embodiment, a hand-held cutting tool (or cutting apparatus) 200 includes a housing 210 (e.g., shaped to be hand-held as shown). The housing 210 includes two cutters (or cutting heads) at opposite ends of the handle, both or at least one of the cutters (or cutting heads) being an embedded blade cutter. In this example embodiment, the housing 210 includes a handle (or handle portion) 220, a first cutting head (portion) 230 at a distal end 231 of the handle 220 and a second cutting head (portion) 330 at a proximal end 233 of the handle 220. The handle 220 is configured for gripping (by a hand) about a lengthwise (gripping) portion 221 of the handle between opposite ends thereof. The cutting heads 230, 330, at opposite ends of the handle, respectively, each provide at least part of or include an embedded blade cutter. An embedded blade (or blade) 212 and a tape splitter (or tape splitter component) 214 are secured within the first cutting head (that includes a box cutter), and an additional embedded blade (or blade) 312 is secured within the second cutting head 330 (that includes a film cutter). The housing 210 includes has a left side 222 and a right side 224 at opposite sides of the blades 212, 312 and the tape splitter 214. As shown in FIGS. 27 and 40, the handle 220 includes a recess (or recessed portion) 240 at a side thereof (e.g., a recessed side portion/area of the handle as shown). The housing 210 also includes a clip 250 that is connected to (or integrally formed with) the handle 220 between the two cutting heads 230, 330, the clip 250 including a resilient (arm) member 251 extending (generally lengthwise) along the handle (e.g., shaped/configured as shown). The housing 210 can be formed of various materials, for example, a moldable composite material (e.g., a material: glass-filled polymer or glass-filled plastic (GF), polytetrafluoroethylene (PTFE) nylon), and by various processes (e.g., insert molded). For example, the housing 210 can be molded or otherwise formed around the blades 212, 312 and the tape splitter 214 such that the left and right sides of the housing are (permanently) positioned in relation to each other with the blades 212, 312 and the tape splitter 214 secured therebetween and adjacent to each other (FIGS. 33, 36 and 37). The term "embedded blade" can refer (for example) to a blade that is secured within or to or otherwise connected to a cutting head and/or handle of a hand-held cutting tool. The blades 212, 312 can be formed of various materials, for example, steel (e.g., SAE 1095 steel heat treated to HRC 58-60). The tape splitter 214 can be formed of various materials, for example, steel (or a high strength plastic).

Figure 39:
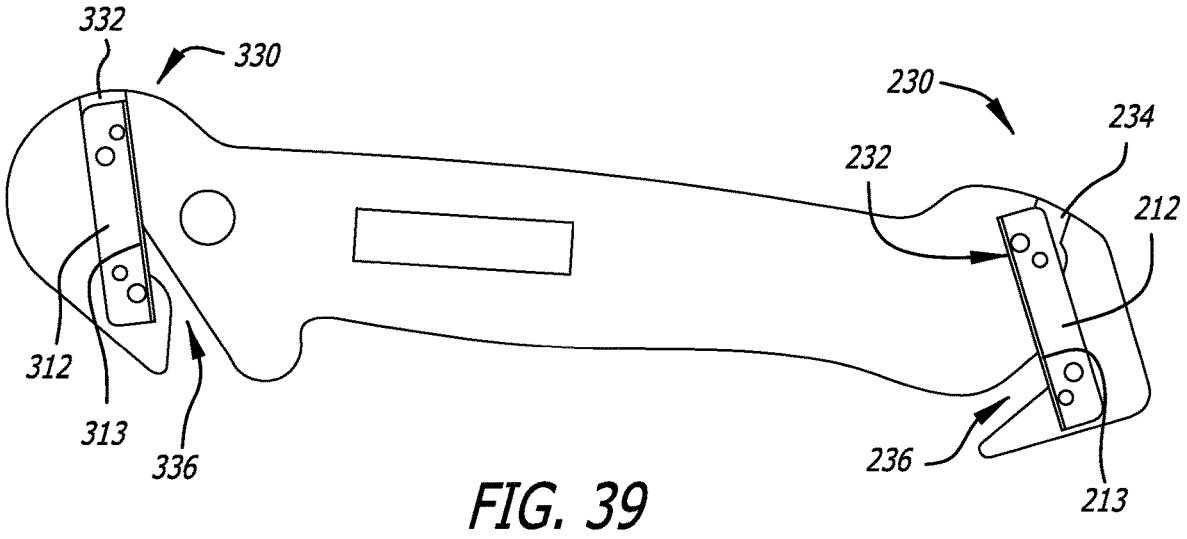
FIG. 39 a cross-sectional right side view of the cutter apparatus (of FIG. 21) showing blade receiving recesses/channels of the film cutter and the box cutter, respectively—the tape splitter are not shown in this view.
Figure 40:
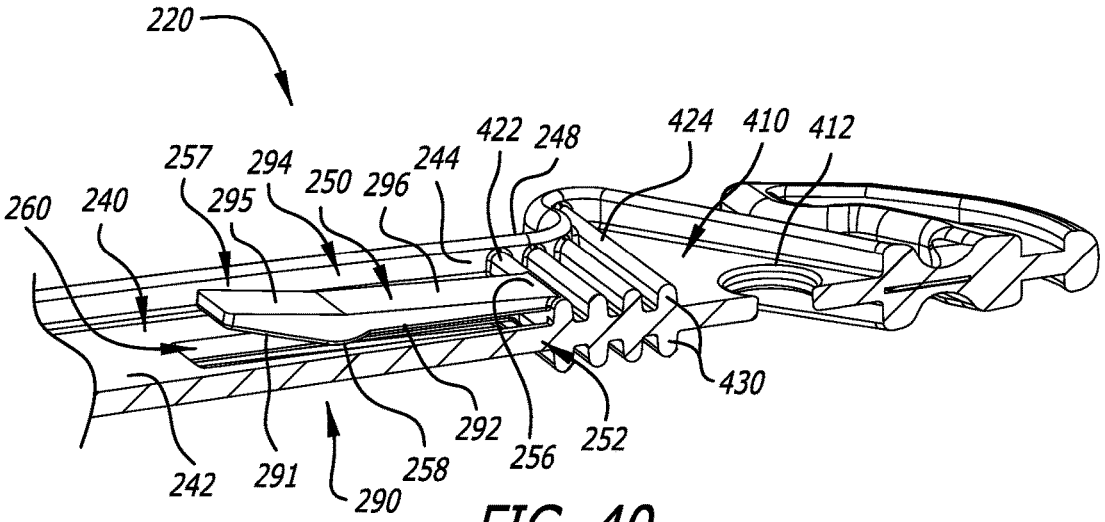
FIG. 40 is a cross-sectional isometric perspective view of the proximal end of the cutter apparatus showing a recess of the handle and a connection interface at which a clip is connected to the handle, the connection interface including an arcuate side wall portion of the recess (an arcuate side wall portion of a ridge or wall structure).

Referring to FIGS. 36 and 39, the first cutting head 230 includes the blade 212 secured within a blade receiving recess/channel 232, and the tape splitter 214 secured within a tape splitter (keyed) recess/channel 234 adjacent to the blade receiving recess/channel 232. The first cutting head 230 includes a (cutting) channel 236 formed as shown and extending into the blade receiving recess/channel 232. When secured within the blade receiving recess/channel 232, a cutting portion 213 of the blade 212 is located (e.g., visible/exposed) within the channel 236. The second cutting head 330 includes the blade 312 secured within a blade receiving recess/channel 332. The second cutting head 330 includes a (cutting) channel 336 formed as shown (see also FIG. 35, which shows channel 336 without blade 312) and extending into the blade receiving recess/channel 332. When secured within the blade receiving recess/channel 332, a cutting portion 313 of the blade 312 is located (e.g., visible/exposed) within the channel 336. In example embodiments, the embedded blades 212, 312 (or the cutting portions 213, 313 thereof) are coplanar (as shown in FIG. 39).

Referring to FIG. 27, the cutting portions 213, 313 include cutting edges 214, 314, respectively (visible/exposed within the cutting channels 236, 336 as shown). In example embodiments, the edge of one of the embedded blades forms an obtuse angle with a longitudinal axis of or associated with the handle. For example, and as shown in FIG. 27, the cutting edge 214 forms an obtuse angle with a longitudinal axis (denoted "LA") defined by a lengthwise surface of the clip 250 or of an opening 260 facing the clip 250, and the cutting edge 314 forms an acute angle with the longitudinal axis.

Figure 22:
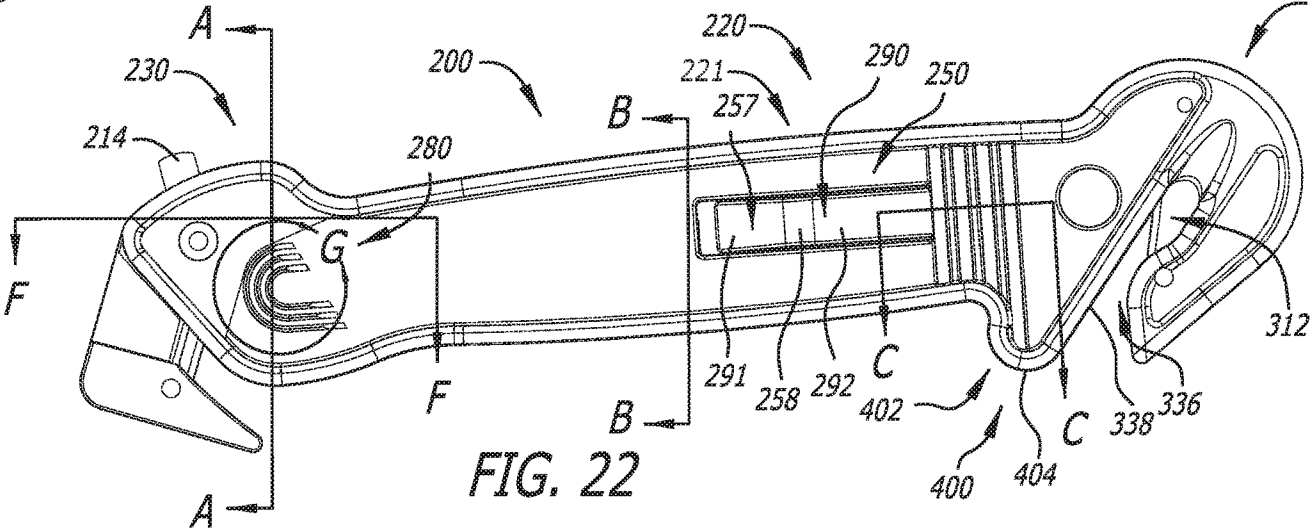
Figure 26:
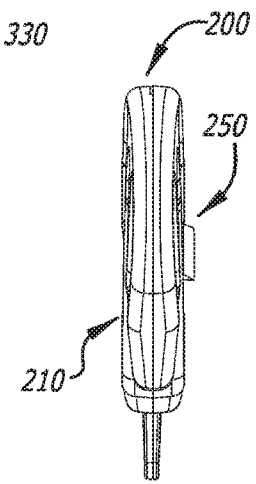
Figure 25:
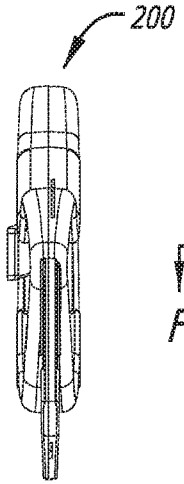
Figure 24:
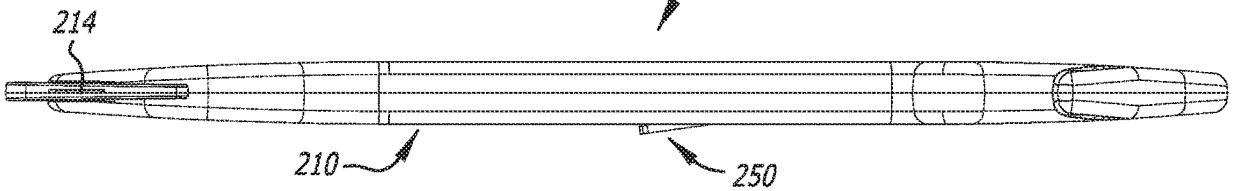

Referring to FIGS. 22 and 27, the handle 220 includes a (palm/hand/finger) guard 400 between the clip 250 and one of the embedded blade cutters—in this example embodiment, the second cutting head 330. The (palm/hand/finger) guard 400 includes a protrusion 402, transitioning at a periphery edge 404 thereof (at its widest portion laterally in relation to the handle sides) to an inside wall 338 of the (cutting) channel 336 within which the blade 312 of the embedded blade cutter is held. Referring to FIG. 27, the housing 210 includes, adjacent to the protrusion 400, a recessed portion (or recess) 410 including (or being provided with) an opening (or aperture) 412 therethrough (suitable for a lanyard, or to serve as a hanger hole). The handle 220 includes (a series of) ridges 420 laterally extending across the handle 220 adjacent to and in part defining the recessed portion 410. The clip 250 includes a base portion 256 connected (or otherwise secured) to the handle 220 between the (palm/hand/finger) guard 400 and one of the embedded blade cutters—in this example embodiment, the first cutting head 230.

Referring to FIGS. 27 and 40, the handle 220 includes a recess 240 (e.g., a recessed side portion/area) within which the clip 250 is secured to the handle 220 (e.g., integrally formed with or otherwise connected or secured to a ridge (or wall) that extends across the handle). The handle 220 includes a ridge 422 that (laterally) extends across the handle 220 (e.g., as shown), the ridge 422 (at portions thereof adjacent to the base 256 of the clip 250) defining inside wall portions 241 of the recess. The handle 220 includes an (arcuate) interconnection interface 252 (e.g., at the ridge 422, such as shown, that (laterally) extends across the handle) at which the base portion 256 of the clip 250 is secured (e.g., integrally formed with or otherwise connected) to the handle 220. The recess 240 also includes a (substantially planar) bottom surface (or area) 242 and adjoining periphery walls (or wall portions) (contiguous with the bottom surface or area, e.g., as shown) that define a periphery (or boundary) 246 of the recess 240. The handle 220 includes ridges (laterally) extending between periphery portions of the handle, the periphery portions including inside-facing walls/surfaces 244 (adjacent to the ridges) that in part define (sides of) the recess 240. The ridges 420 are recessed (e.g., as shown in FIG. 40, at the top (or apex) 424 of each ridge) in relation to adjacent top edges 248 of the periphery portions (of the handle). At both sides, the handle 220 includes gripping structure 430 including (a series of) ridges (ribs or other engagement elements) (laterally) extending across the handle, the ridges separating (and in part defining) recesses (or recessed areas) at opposite ends of the gripping structure—in this example embodiment, the recesses 240, 410 previously discussed. Referring to FIGS. 22, 27 and 40, in this example embodiment, the clip 250 is only connected to or in contact with the handle 220 at an (arcuate) interconnection interface 252 (e.g., at a ridge, such as shown, that (laterally) extends across the handle) at which a base portion 256 of the clip 250 is secured (e.g., integrally formed with or otherwise connected) to the handle 220. The bottom surface (or area) 242 of the recess 240 includes the opening 260 facing the clip 250 and provided through the handle 220 as shown. The handle 120 includes surfaces 262 that define the opening 260 including a periphery boundary of the opening (e.g., at a bottom surface of the recess) circumscribing or generally being co-aligned with side surfaces(/portions) 254 of the clip 250 though, in this example embodiment, not circumscribing the base (or base portion) 256 of the clip 250. The recess 240 has a periphery (or boundary) 246 defined (at least in part) by side wall surfaces (/portions) 226 of the handle 220 and/or the (contiguous) side surfaces(/portions) 254 of the clip 250. Accordingly, the clip 250 is (integrally formed with or) connected at its base (portion) 256 to the handle at a location within (e.g., interconnection location or juncture of) the recessed portion 240 of the handle 220. The clip 250 is connected to or in contact with the handle 220 only at the (interconnection) location—independent of whether the resilient member 251 of the clip 250 flexes or otherwise repositions in relation to the base (portion) 256 of the clip 250.

Figure 30:
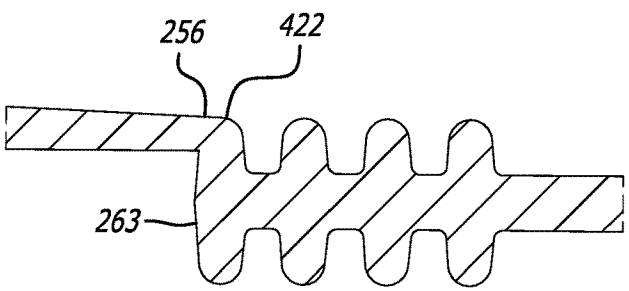
FIG. 30 is a cross-sectional magnified view of the cutter apparatus at lines C-C of FIG. 22 showing a series of ridges that includes an interconnection support structure and a clip extending therefrom.
Figure 32:
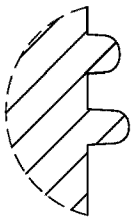
FIG. 32 is a cross-sectional view showing in isolation the portion of FIG. 31 denoted DETAIL E.
Figure 29:
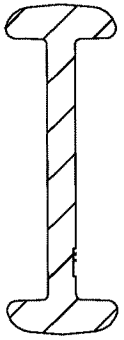
FIG. 29 is a cross-sectional view of the cutter apparatus at lines B-B of FIG. 22 showing side wall surfaces defining recesses at opposite (the left and right) sides of the handle.
Figure 31:
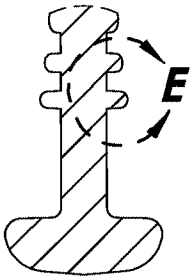
FIG. 31 is a cross-sectional magnified view of the portion of FIG. 28 denoted DETAIL D showing portions of the U-shaped gripping ridges in profile.
Figure 28:
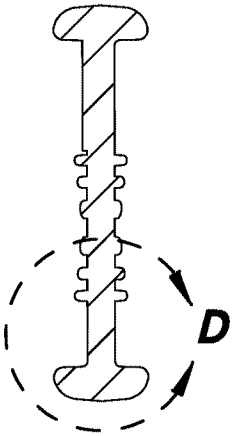
FIG. 28 is a cross-sectional view of the cutter apparatus at lines A-A of FIG. 22 showing generally U-shaped gripping ridges at left and right distal side portions of the handle.

The handle 220 includes (and the recess 240 is in part defined by) a ridge or wall structure (such as the ridge 422) at a proximal end 233 of the handle, and the clip 250 (at its base portion 256) is (integrally formed with or) connected to ridge or wall structure. Referring additionally to FIG. 30, the handle 220 includes (and the recess 240 is in part defined by) a ridge (such as the ridge 422) adjacent to and contiguous with a portion 263 of the opening 260, and the clip 250 is connected at a base portion thereof to the ridge.

Thus, in an example embodiment, a hand-held cutting tool includes a handle configured for gripping (by a hand) about a lengthwise (gripping) portion of the handle between opposite ends thereof, two cutting heads, at the opposite ends of the handle, respectively, the cutting heads each providing at least part of or including an embedded blade cutter, and a clip (integrally formed with or) connected to the handle between the two cutting heads. In example embodiments, each of the cutting heads has a blade (an embedded blade) that is secured within or to (e.g., connected to) the cutting head, a cutting portion thereof being located (e.g., visible/exposed) within a channel (or other opening, recess or the like) of the cutting head.

Referring to FIGS. 22, 27 and 40, the clip 250 includes an angled end portion 257 at an opposite end of the clip in relation to the base portion 256, and the handle 220 includes (or is provided with) (concentric/equidistantly nested) generally U-shaped (raised) gripping ridges 280 (see also FIGS. 28, 31, 32 and 34) having beveled portions(/surfaces) 282 at the ends of each ridge (FIG. 34), the beveled portions 282 facing the angled end portion 257 of the clip 250.

Referring to FIGS. 22 and 40, the clip 250 includes an inwardly facing engagement portion 258 (for securing/clipping the tool to a pocket), e.g., a protrusion shaped/configured as shown, that is wider laterally in relation to the handle 220 than at either the base portion 256 or the angled end portion 257 of the clip 250. The clip 250 includes two generally planar surfaces 291, 292 at and defining different (non-adjacent) portions of an inward facing side 290 of the clip 250, the planar surfaces not being parallel in relation to each other (e.g., not located within respective planes that are parallel to each other). The engagement portion 258 transitions (curves) between the two generally planar surfaces 291, 292 (e.g., as shown). The clip 250 also includes two generally planar surfaces 295, 296 at and defining different (adjacent and contiguous) portions of an outward facing side 294 of the clip 250, the planar surfaces not being parallel in relation to each other (e.g., not located within respective planes that are parallel to each other).

Thus, in an example embodiment, a hand-held cutting tool includes a handle, at least one cutting head with an embedded blade, the at least one cutting head being connected to the handle, and a clip connected to the handle within a recess thereof, the clip including a resilient member extending generally lengthwise along the handle. Each of the cutting head(s) is connected to the handle at an end thereof (i.e., at one or the other of two ends of the handle along a lengthwise portion thereof). The clip is connected at a base portion thereof to the handle at a location within (e.g., an interconnection location or juncture of) the recess. The clip is only connected to or in contact with the handle at the location independent of whether the resilient member (of the clip) flexes or otherwise repositions in relation to the base portion of the clip. In example embodiments, the recess has a periphery (or boundary) defined (at least in part) by side wall surfaces(/portions) of the handle and side surfaces(/portions) of the clip. In example embodiments, the recess has a periphery (or boundary) defined (in part) by (contiguous) side surfaces(/portions) of the clip. The handle includes an opening (therethrough), surfaces of the handle that define the opening, including a periphery boundary of the opening (e.g., at a bottom surface of the recess), circumscribing or generally being co-aligned with side surfaces(/portions) of the clip though not circumscribing the base of the clip. The handle includes (and the recess is in part defined by) a ridge or wall structure, and the clip is (integrally formed with or) connected at a base portion thereof to the ridge or wall structure. In example embodiments, the handle includes (and the recess is in part defined by) a ridge, e.g., adjacent to and contiguous with a portion of the opening, and the clip is (integrally formed with or) connected at a base portion thereof to the ridge. In example embodiments, the handle includes (and the recess is in part defined by) an annular or ring-like wall structure (e.g., that also defines, at its interior, a lanyard or hanger hole opening), and the clip is (integrally formed with or) connected at a base portion thereof to a periphery portion of the wall structure.

Example embodiments involve a hand-held cutting tool with a cutting head that has improved structural integrity, durability or strength and/or an embedded blade for such a hand-held cutting tool. Example embodiments involve a hand-held cutting tool in which the embedded blade has multiple operative surface portions, for example, a cutting edge and a tape splitter portion. Example embodiments involve a hand-held cutting tool in which the embedded blade consists of a single unitary piece made of metal or other material(s).

Figures 41, 42, 43:
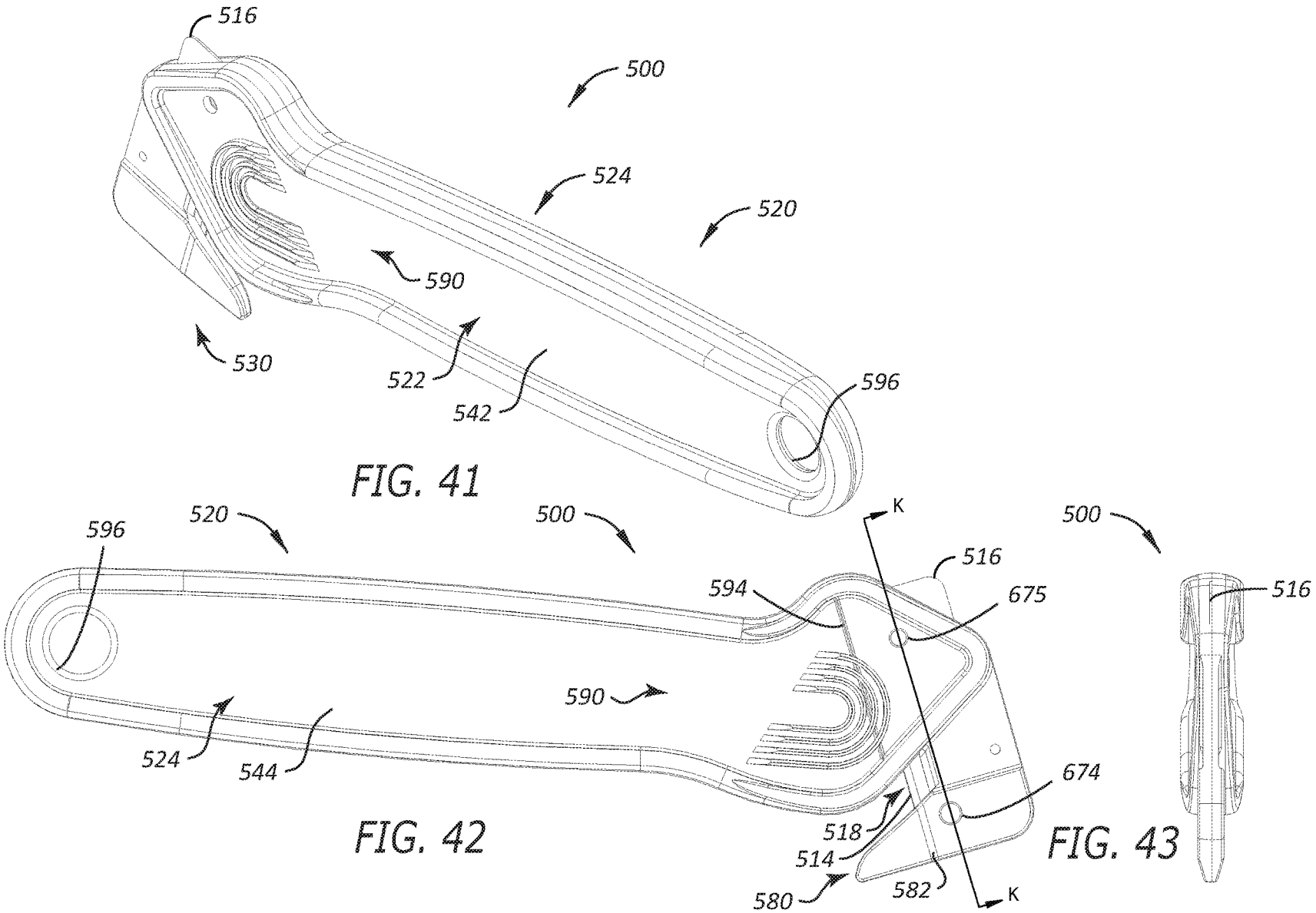
Figure 47:
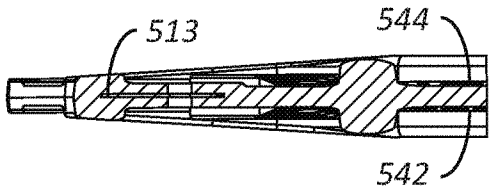
Figure 46:
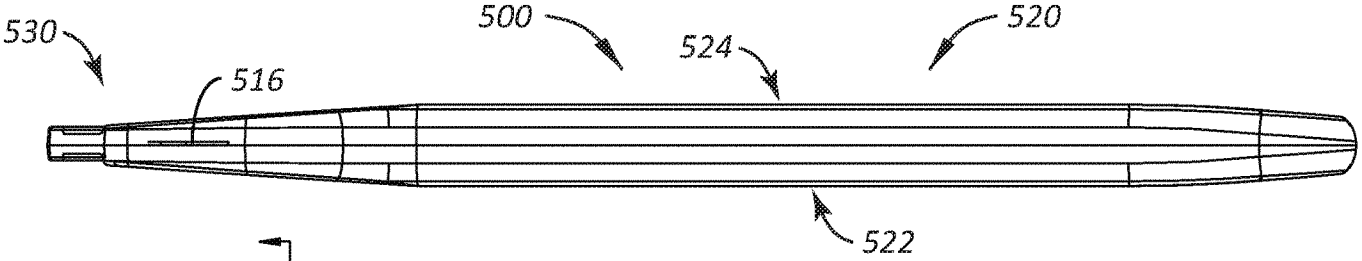
Figure 45:
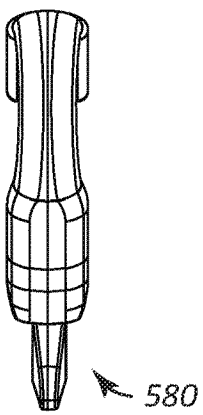
Figure 44:
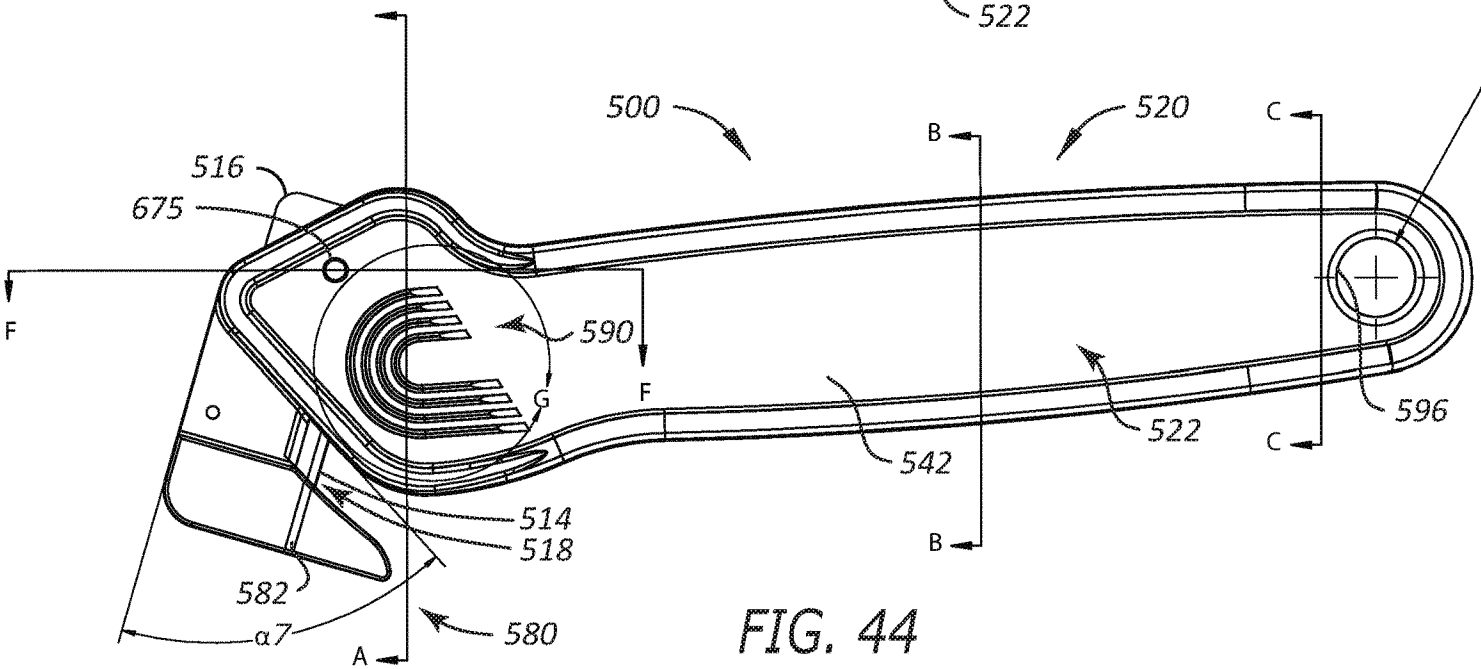
Figure 48:
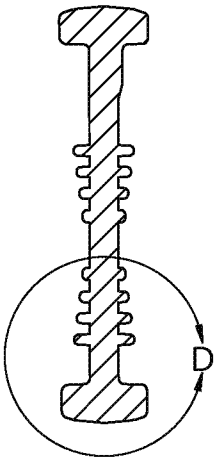
Figure 49:
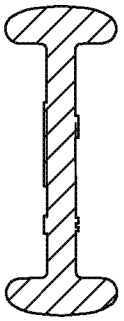
Figure 50:
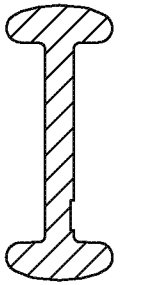
Figure 51:
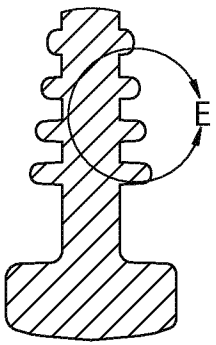
Figure 52:
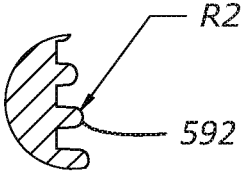

Referring to FIGS. 41-60, in another example embodiment, a hand-held cutting tool (or cutting apparatus) 500 includes a housing (e.g., shaped to be hand-held as shown), an embedded tool (or blade) 512 having multiple operative surface portions. In this example embodiment, the embedded tool (or blade) 512 consists of a single unitary piece 513 (see. e.g., FIGS. 57-60) made of metal or other material(s), the multiple operative surface portions thereof including a cutting edge 514 and a tape splitter portion 516 at an opposite side 517 of the unitary piece from the cutting edge. The housing includes a handle (or handle portion) 520, and has a left side 522 and a right side 524 at opposite sides of the blade 512. The housing includes a cutting head (portion) 530 at a distal end of the cutting tool 500. As shown in FIGS. 42 and 44, the handle 520 includes recessed side portions/areas 542 and 544 (e.g., formed as shown) at the left and right sides 522 and 524, respectively, of the handle. The housing can be formed of various materials, for example, a moldable composite or other material (e.g., a composite material: glass-filled polymer or glass-filled plastic (GF), polytetrafluoroethylene (PTFE) nylon) (e.g., nylon 6/6 40% GF), and by various processes (e.g., insert molded). For example, the housing can be molded or otherwise formed around the blade 512 such that the left and right sides of the housing are (permanently) positioned in relation to each other with the blade 512 secured therebetween and adjacent to each other (FIG. 47). The term "embedded blade" can refer (for example) to a blade or tool that is secured within or to or otherwise connected to a cutting head and/or handle of a hand-held cutting tool. The blade 512 can be formed of various materials, for example, steel (e.g., SAE 1095 steel heat treated to HRC 58-60) (e.g., SK4 steel heat treated to HRC 62-64) or a high strength plastic.

Figure 56A:
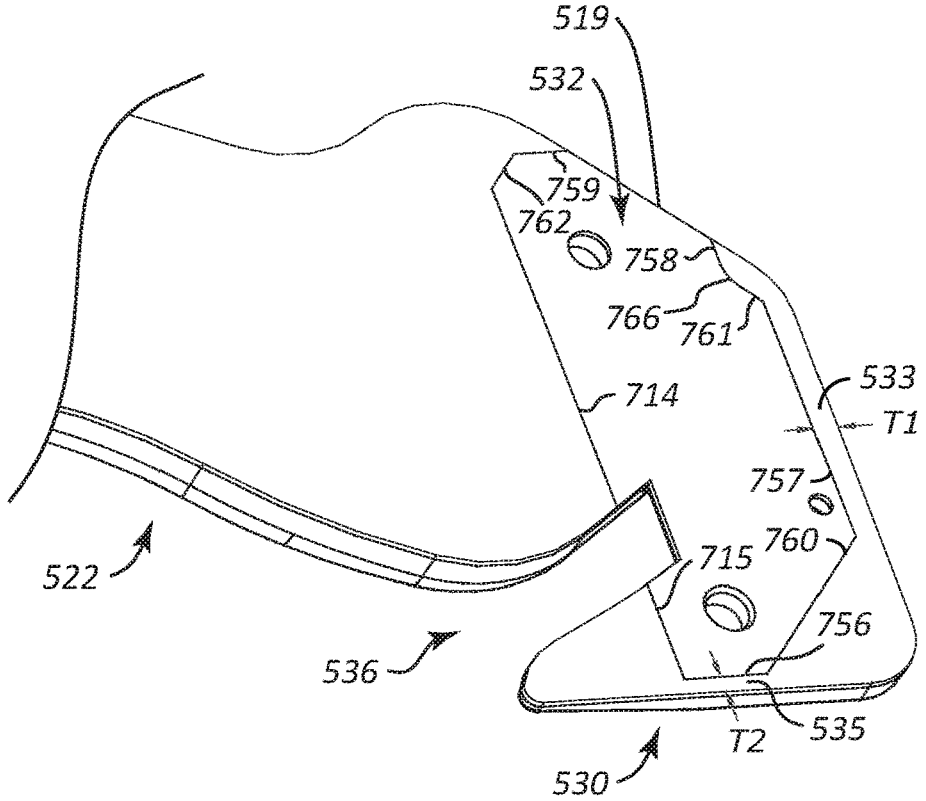
FIG. 56A is a cross-sectional isometric perspective view of the cutter apparatus showing at a distal end thereof an embedded tool or blade receiving recess/channel—the embedded tool consisting of a single unitary metal piece is not shown in this view.
Figure 56B:
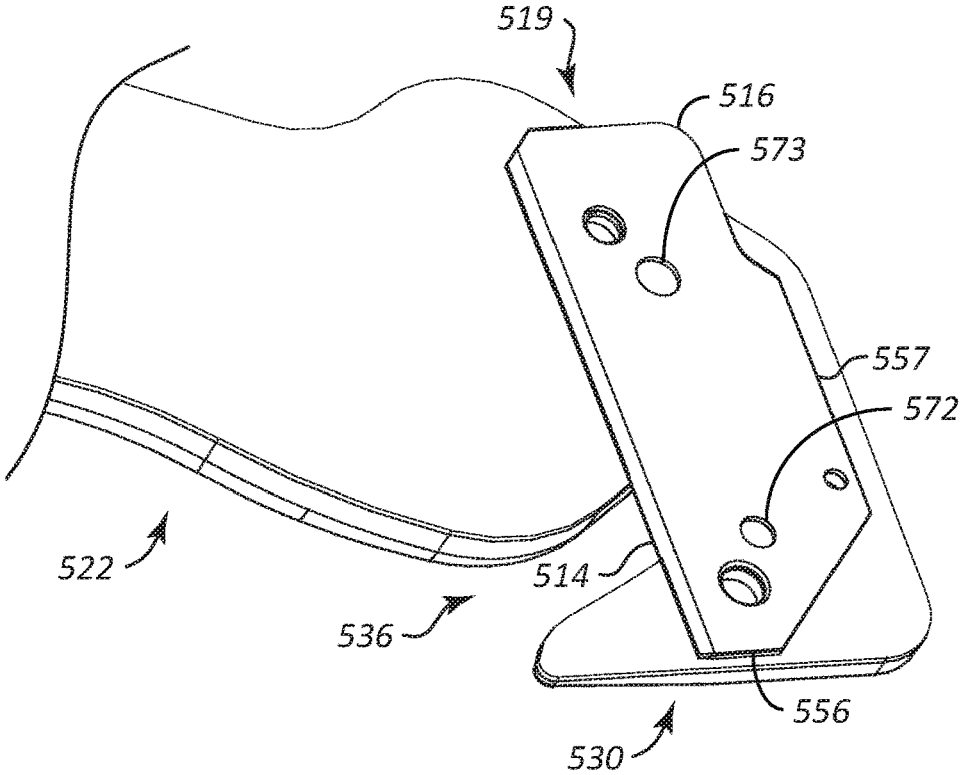
FIG. 56B shows the cross-sectional isometric perspective view of FIG. 56A with the single unitary metal piece positioned within the embedded tool or blade receiving recess/channel and the tape splitter portion of the single unitary metal piece extending from a distal opening in the cutting head (defined by the embedded tool or blade receiving recess/channel)
Figure 60:
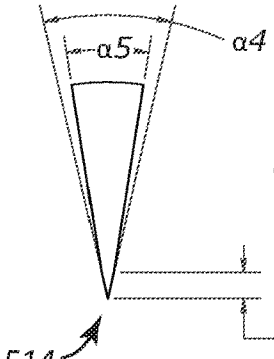
Figure 57:
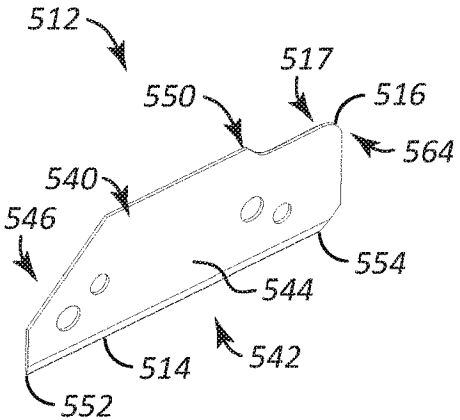
Figure 58:
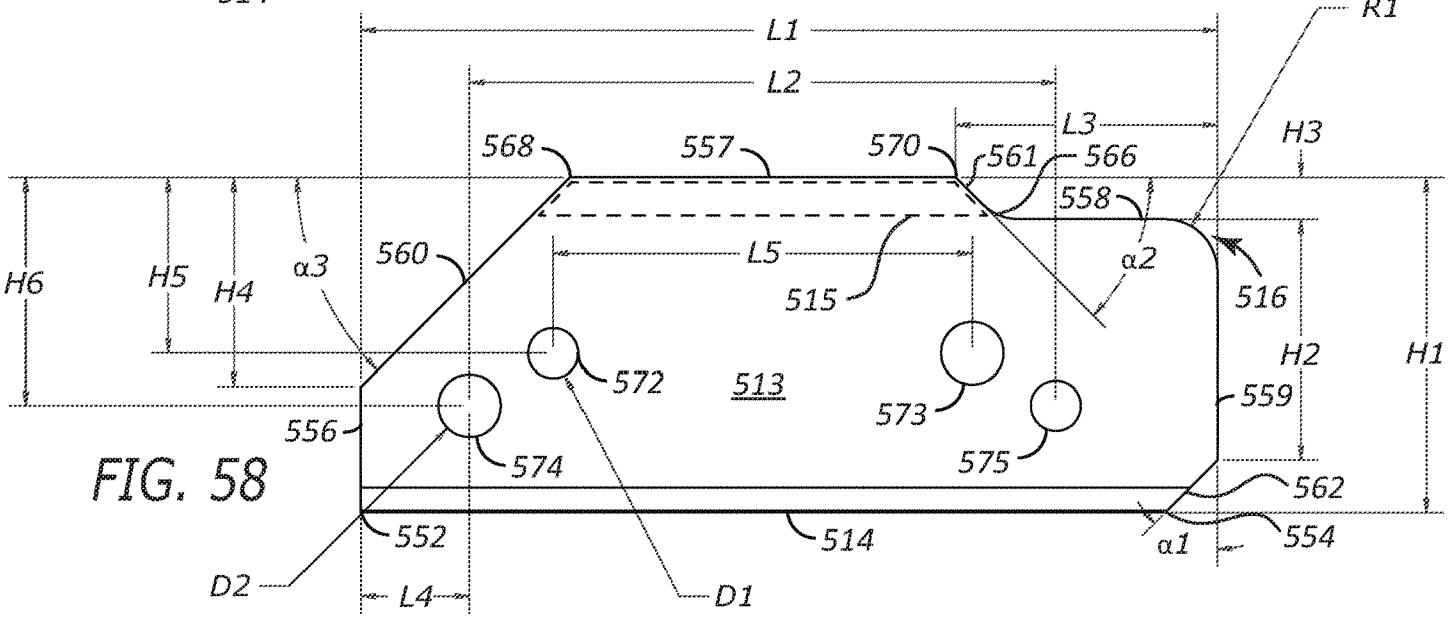
Figure 59:
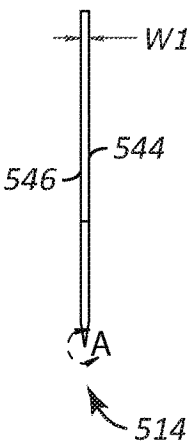

Referring to FIGS. 56A and 56B, the cutting head 530 includes the blade 512—in this example embodiment, provided in the form of single unitary piece (or single metal piece) 513, the multiple operative surface portions thereof including the cutting edge 514 and the tape splitter portion 516—secured within a single blade receiving recess/channel 532. The cutting head 530 includes a (cutting) channel 536 formed as shown and extending into the blade receiving recess/channel 532. When secured within the blade receiving recess/channel 532, a cutting portion 518 (FIGS. 42 and 44) of the blade 512 is located (e.g., visible/exposed) within the channel 536.

Referring to FIGS. 57-60, in this example embodiment, the blade 512 includes a main portion 540 including, at a bottom side 542 thereof, the cutting edge 514, the main portion 540 being planar and substantially uniform in thickness (see e.g. FIG. 59: blade thickness, W1=0.0155±0.0005 inches) between front and back sides 544 and 546 thereof, the main portion 540 including a periphery boundary 550 extending from opposite ends 552 and 554 of the cutting edge 514, the periphery boundary 550 being defined by a plurality of contiguous side surfaces including flat surfaces and curved surfaces. The flat surfaces include a first group of flat surface sections 556, 557, 558, 559 all of which are parallel or orthogonal to the cutting edge 514 and none of which are adjacent to others of the first group. The flat surfaces include a second group of flat surface sections 560, 561, 562 all of which are at a 45° angle (see e.g. FIG. 58: $\alpha$1, $\alpha$2, and $\alpha$3=45°) in relation to the cutting edge 514 and none of which are adjacent to others of the second group. The curved surfaces including the tape splitter portion 516 at a top corner 564 of the main portion 540. The curved surfaces include a curved surface section 566 between the flat surface section 558 of the first group and the flat surface section 561 of the second group. In this example embodiment, the flat surfaces and the curved surfaces, including the tape splitter portion, are nonsharp.

In the example embodiment shown in FIGS. 57-60, the first group of flat surface sections consists of the four first group flat surface sections 556, 557, 558, 559; and the second group of flat surface sections consists of the three second group flat surface sections 560, 561, 562. In other example embodiments and implementations, the first group of flat surface sections includes four or more first group flat surface sections. In other example embodiments and implementations, the second group of flat surface sections includes three or more second group flat surface sections.

In the example embodiment shown in FIGS. 57-60, the cutting edge 514 is adjacent to the first group flat surface section 556 at one end 552 of the cutting edge and adjacent to the second group flat surface 562 at the opposite end 554 of the cutting edge 514. Another of the first group, the flat surface section 559, is located between and adjacent to the tape splitter portion 516 and the second group flat surface section 562 located at the opposite end 554 of the cutting edge 514. In this example embodiment, the second group of flat surface sections consists of three second group flat surface sections 560, 561, 562, which considered as a sequence are orthogonally arranged in relation to each other about the periphery boundary 550. In this example embodiment, the first group of flat surface sections includes the top flat surface section 557 at an opposite side of the main portion (of the blade) from, and parallel to, the cutting edge 514, and the second group of flat surface sections includes the two second group flat surface sections 560 and 561 adjacent to opposite ends 568 and 570, respectively, of the top flat surface section 557. The top flat surface section 557 is part of (and defined by) an uppermost structural reinforcing portion 515 (denoted in dashed lines) of the blade 512. In this example embodiment, the uppermost structural reinforcing portion 515 has a trapezoid shape generally and blends at its right side flat surface section 561 into the curved surface section 566 (e.g., shaped as shown) transitioning into the flat surface side section 558 and then transitioning into the tape splitter portion 516. As an operative surface portion of the blade 512, the tape splitter portion 516 fixedly extends from a distal opening 519 in the cutting head 530, the distal opening 519 being an intersection of the blade receiving recess/channel 532 and the exterior of the cutting head 530 at the distal end of the cutting tool 500. Accordingly, though extending from the cutting head 530, the tape splitter portion 516 is recessed in relation to the embedded uppermost structural reinforcing portion 515 relative to the cutting edge 514 of the blade 512. The length of the uppermost structural reinforcing portion 515 is greater than the length of either side 558, 559 of the tape splitter portion 516; and (as previously discussed) the transition from the uppermost structural reinforcing portion 515 to the tape splitter portion 516 includes the right side flat surface section 561 and the curved surface section 566 which adds strength to the blade 512 making it more difficult for forces bearing laterally on the tape splitter portion 516 to deform the blade from its substantially planar shape or possibly crack the cutting head 530 (e.g., at or near the distal opening 519) and the uppermost structural reinforcing portion 515 located and embedded as shown further strengthens the cutting head 530 in this regard.

Figure 53:
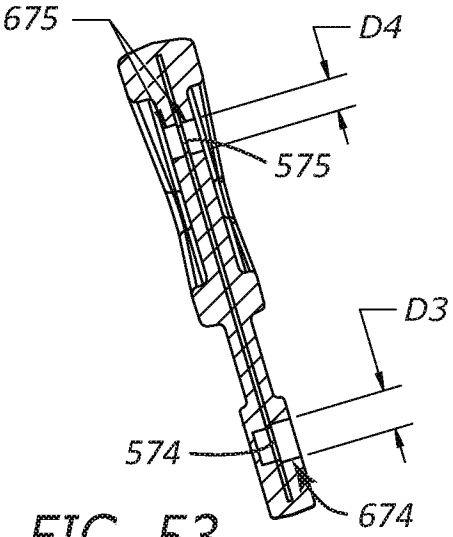

The main portion 540 includes pairs of openings along the main portion and symmetrically positioned in relation to the opposite ends 568 and 570 of the top flat surface section 557. In this example embodiment, the pairs of openings include a first pair of openings 572 and 573 and a second pair of openings 574 and 575, and each of the pairs of openings includes as shown and described herein two different sized circular openings located at the opposite ends 568 and 570, respectively, of the top flat surface section 557. Referring also to FIGS. 42, 44 and 53, during an example process of molding the cutting head 530 around the blade 512 along with the handle 520, pins (not shown) clamp the blade 512 from both sides at the periphery of the opening 575 and at the right side periphery of the opening 574 once the plastic has entered the mold. The openings 674 and 675 in the cutting head 530 are formed during the molding process as the pins remain in place while the plastic is cooling. As shown in FIG. 56B, in this example embodiment, the first pair of the openings 572 and 573 in the main portion 540 of the metal piece are located at opposite sides of the channel 536, respectively, and are filled through the openings between opposite sides of the cutter head with cutter head material for enhanced structural stability. The second pair of the openings 574 and 575 in the main portion 540 of the metal piece also located at opposite sides of the channel 536, respectively, as discussed above are configured to receive pins that hold the single metal piece 513 in a mold tool during fabrication of the cutting tool, resulting in formation of the openings 674 and 675 (FIGS. 42, 53) in the cutting head 530 from being molded around the pins, which are subsequently removed.

Accordingly, in this example embodiment, the periphery boundary 550 extending from opposite ends 552 and 554 of the cutting edge 514 includes and is defined by a sequence of nine surface sections, the first four (sections 556, 560, 557, 561) and the last two (sections 559, 562) of which are flat and change directions by 45° in relation to each other at each section transition between them along the periphery boundary 550; the curved surface section 566 provides a transition between the flat surface sections 561 and 558; and the curved surface section (tape splitter portion) 516 provides a transition between the flat surface sections 558 and 559 (the flat side sections, or sides, of the tape splitter), which are orthogonal in relation to each other. In this example embodiment, among flat surfaces of the periphery boundary 550 and the cutting edge 514, considering such surfaces in relation to each other about the blade 512 disregarding curved surfaces, the only other adjacent pair of flat surfaces that are orthogonal are the flat surface 556 and the cutting edge 514, and this pair is located (on the blade) diametrically opposite from the orthogonal adjacent pair of flat surfaces provided by the surface sections 558 and 559.

With reference to FIGS. 44, 52, 53, 55, 56A and 58-60, example dimensions for the hand-held cutting tool 500 and the blade 512 are as follows: L1=1.610 inches; L2=1.102 inches; L3=0.492 inches; L4=0.205 inches; L5=0.787 inches; H1=0.630 inches; H2=0.453 inches; H3=0.079 inches; H4=0.394 inches; H5=0.331 inches; H6=0.429 inches; H7=0.004±0.001 inches; T1=60 to 80 thousands of an inch; T2=60 to 80 thousands of an inch; W1=0.0155±0.0005 inches; D1=0.094 inches; D2=0.118±0.002 inches; D3=0.138 inches; D4=0.114 inches; D5=0.380 inches; R1=0.98 inches; R2=0.016 inches; α1=45°; α2=45°; α3=45°; α4=26°; α5=18°; α6=10°; α7=58°.

Thus, in an example embodiment, a blade for a hand-held cutting tool includes a main portion including, at a bottom side thereof, a cutting edge, the main portion being planar and substantially uniform in thickness between front and back sides thereof, the main portion including a periphery boundary extending from opposite ends of the cutting edge, the periphery boundary being defined by a plurality of contiguous side surfaces including flat surfaces and curved surfaces, the flat surfaces including a first group of flat surface sections all of which are parallel or orthogonal to the cutting edge and none of which are adjacent to others of the first group, the flat surfaces including a second group of flat surface sections all of which are at a 45° angle in relation to the cutting edge and none of which are adjacent to others of the second group, the curved surfaces including a tape splitter portion at a top corner of the main portion.

Thus, in an example embodiment, a hand-held cutting tool includes a handle and a cutting head with an embedded tool having multiple operative surface portions, the cutting head being connected to the handle, the embedded tool consisting of a single unitary metal piece, the multiple operative surface portions thereof including a cutting edge and a tape splitter portion at an opposite side of the metal piece from the cutting edge, the cutting head including a distal opening and a channel sized to receive a workpiece therein, the embedded tool being molded or otherwise secured within the cutting head such that the tape splitter portion extends from the distal opening and a portion of the cutting edge extends from the cutting head and is located and exposed within the channel for cutting a workpiece that is advanced into the channel and brought into contact with the cutting edge; wherein the embedded tool includes a top flat surface section which is part of and defined by an uppermost structural reinforcing portion of the single unitary metal piece; and wherein the tape splitter portion is recessed in relation to the uppermost structural reinforcing portion relative to the cutting edge of the blade. In the illustrated example embodiment, the length of the uppermost structural reinforcing portion is greater than the length of either side of the tape splitter portion.

Referring also to FIG. 56A, in this example embodiment, a portion 533 of the cutting head adjacent to the top flat surface section 557, within which the embedded tool is secured, has a thickness (denoted T1) of 60 to 80 thousands of an inch. Also, in this example embodiment, the embedded tool includes the side flat surface section 556 (of the embedded tool) is at an opposite end of the single unitary metal piece from the tape splitter, and a portion 535 of the cutting head adjacent to the side flat surface section 556, within which the embedded tool is secured, has a thickness (denoted T2) of 60 to 80 thousands of an inch. In this example embodiment, the cutting head 530 includes, or is formed with, a recess (the blade receiving recess/channel 532) including walls, namely, interior wall sections 714, 715, 756, 760, 757, 761, 766, 758, 759, 762, complementary in shape with portions (previously described) of the cutting edge 514 and the periphery boundary 550 and sized to receive and secure the single metal piece 513 within the cutting head 530.

Figure 55:
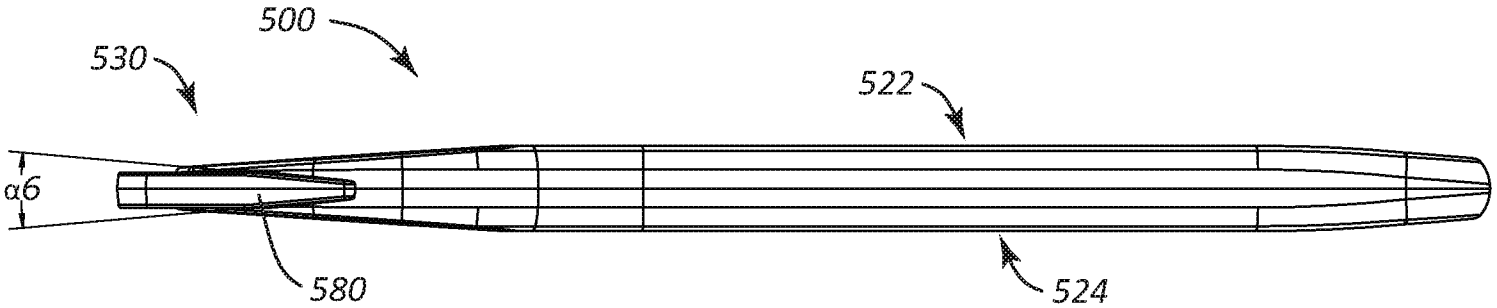

In example embodiments and implementations, a hand-held cutting tool has a cutting head that includes, or is provided with, surfaces or other structures providing visual indicators of cutting edge location and/or orientation in relation to a cutting channel of the tool that receives a workpiece or other object to be cut. Referring to FIGS. 42 and 44, in this example embodiment, the cutting head 530 includes the channel 536, which is sized to receive a workpiece therein. The embedded tool (or blade) 512 is molded or otherwise secured within the cutting head 530 such that a cutting portion 518 of the cutting edge 514 extends from the cutting head 530 and is located and exposed within the channel 536 for cutting a workpiece that is advanced into the channel and brought into contact with the cutting edge. Referring to FIGS. 42, 44 and 55, the cutting head 530 includes a hook portion 580 (e.g., shaped and oriented as shown) at an opposite side of the channel 536 from the handle 520, the hook portion 580 including (e.g., as shown at both sides thereof) a visually distinct narrow surface section 582 (e.g., a surface region/area that is angled, beveled or otherwise visually distinct from adjacent areas of the hook portion 580) coaligned with the cutting edge 514 of the blade.

Thus, in an example embodiment, a hand-held cutting tool includes a handle and a cutting head with an embedded tool including a cutting edge, the cutting head being connected to the handle, the cutting head including a channel sized to receive a workpiece therein, the embedded tool being molded or otherwise secured within the cutting head such that a portion of the cutting edge extends from the cutting head and is located and exposed within the channel for cutting a workpiece that is advanced into the channel and brought into contact with the cutting edge; wherein the cutting head includes a hook portion at an opposite side of the channel from the handle, the hook portion including a visually distinct narrow surface section coaligned with the cutting edge of the blade.

Figure 54:
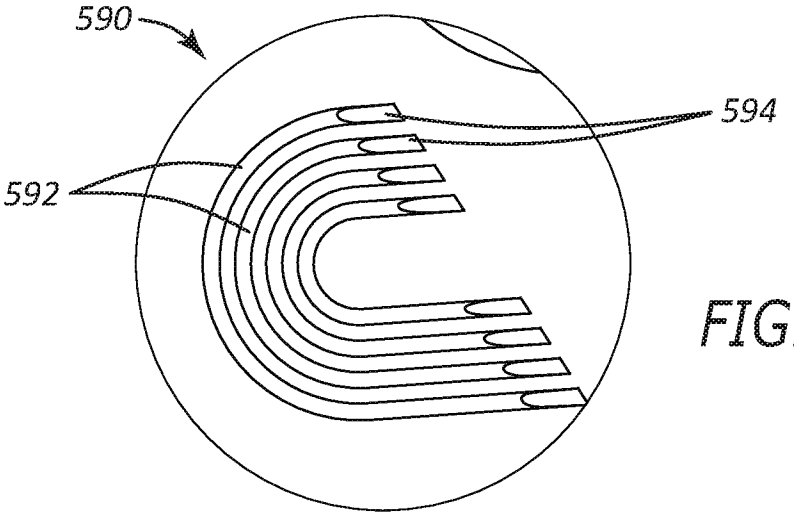

Referring to FIGS. 42, 44 and 54, in this example embodiment, the handle 520 at both sides includes a gripping structure 590 including ridges 592 extending across the handle 520 adjacent to the cutting head 530; and the handle 520 further includes at the right side 524 a cut line/guide structure 594 (e.g., a ridge or step) that is parallel with the cutting edge 514, the cut line/guide structure 594 being visible through openings (spaces) between the ridges 592. In this example embodiment, the ridges 592 are generally U-shaped gripping ridges having beveled portions 594 at the ends of each ridge. In example embodiments and implementations, the embedded tool (or blade) 512 consists of a single metal piece with multiple operative surface portions including a cutting edge and a tape splitter portion at an opposite side of the metal piece from the cutting edge; and the embedded tool (or blade) is molded or otherwise secured within the cutting head such that the tape splitter portion extends from a distal opening in the cutting head. In example embodiments, the hand-held cutting tool 500 includes, at the base of the handle 520, an opening 596 (e.g., a lanyard or hanger hole opening provided as shown).

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A hand-held cutting tool comprising:

a handle; and a cutting head with an embedded blade having multiple operative surface portions, the cutting head being connected to the handle, the embedded blade consisting of a single unitary metal piece, the multiple operative surface portions thereof including a cutting edge and a tape splitter portion, which is at an opposite side of the metal piece from the cutting edge, the cutting head including a distal opening and a channel sized to receive a workpiece therein, the embedded blade being molded or otherwise secured within the cutting head such that the tape splitter portion extends from the distal opening and a portion of the cutting edge extends from the cutting head and is located and exposed within the channel for cutting the workpiece that is advanced into the channel and brought into contact with the cutting edge;

wherein the embedded blade includes a top flat surface section which is part of and defined by an uppermost structural reinforcing portion of the single unitary metal piece; and wherein the tape splitter portion is recessed in relation to the uppermost structural reinforcing portion relative to the cutting edge.

2. The hand-held cutting tool of claim 1, wherein the length of the uppermost structural reinforcing portion is greater than the length of either side of the tape splitter portion.

3. The hand-held cutting tool of claim 1:

wherein a portion of the cutting head adjacent to the top flat surface section, within which the embedded blade is secured, has a thickness of 60 to 80 thousands of an inch.

4. The hand-held cutting tool of claim 1:

wherein the embedded blade includes a side flat surface section at an opposite end of the single unitary metal piece from the tape splitter portion; and wherein a portion of the cutting head adjacent to the side flat surface section, within which the embedded blade is secured, has a thickness of 60 to 80 thousands of an inch.

5. The hand-held cutting tool of claim 1:

wherein the single metal piece of the embedded blade includes a main portion including, at a bottom side thereof, the cutting edge, the main portion being planar and substantially uniform in thickness between front and back sides thereof, the main portion including a periphery boundary extending from opposite ends of the cutting edge, the periphery boundary being defined by a plurality of contiguous side surfaces including flat surfaces and curved surfaces, the flat surfaces including a first group of flat surface sections all of which are parallel or orthogonal to the cutting edge and none of which are adjacent to others of the first group, the flat surfaces including a second group of flat surface sections all of which are at a 45° angle in relation to the cutting edge and none of which are adjacent to others of the second group, the curved surfaces including the tape splitter portion at a top corner of the main portion; and wherein the cutting head includes, or is formed with, a recess including walls complementary in shape with portions of the cutting edge and of the periphery boundary and sized to receive and secure the single metal piece within the cutting head.

6. The hand-held cutting tool of claim 5, wherein the tape splitter portion is nonsharp, and the cutting edge is sharpened.

7. The hand-held cutting tool of claim 5, wherein the first group of flat surface sections comprises four first group flat surface sections;

wherein the second group of flat surface sections comprises three second group flat surface sections; and wherein the cutting edge is adjacent to a first group flat surface section of the four first group flat surface sections at one end of the cutting edge and adjacent to a second group flat surface section of the three second group flat surface sections at an opposite end of the cutting edge.

8. The hand-held cutting tool of claim 7, wherein another of the four first group flat surface sections is located between and adjacent to the tape splitter portion and said second group flat surface section located at the opposite end of the cutting edge.

9. The hand-held cutting tool of claim 5, wherein the curved surfaces include a curved surface section between one of the flat surface sections of the first group of flat surface sections and one of the flat surface sections of the second group of flat surface sections.

10. The hand-held cutting tool of claim 5, wherein the second group of flat surface sections consists of three second group flat surface sections, which considered as a sequence are orthogonally arranged in relation to each other about the periphery boundary.

11. The hand-held cutting tool of claim 5:

wherein the first group of flat surface sections includes a top flat surface section at an opposite side of the main portion from, and parallel to, the cutting edge.

12. The hand-held cutting tool of claim 11:

wherein the second group of flat surface sections includes two second group flat surface sections adjacent to opposite ends of the top flat surface section, respectively.

13. The hand-held cutting tool of claim 11:

wherein the main portion includes pairs of openings along the main portion and symmetrically positioned in relation to opposite ends of the top flat surface section.

14. The hand-held cutting tool of claim 13, wherein each pair of openings includes two different sized circular openings at opposite ends of the top flat surface section, respectively.

15. The hand-held cutting tool of claim 13, wherein openings of the pairs of openings include a pair of fill openings in the main portion of the metal piece, the fill openings being located at opposite sides of the channel, respectively, and the pair of fill openings arranged between opposite sides of the cutting head and filled with cutting head material for enhanced structural stability.

16. The hand-held cutting tool of claim 13, wherein openings of the pairs of openings include a pair of pin openings in the main portion of the metal piece, the pin openings being located at opposite sides of the channel, respectively, and the pair of pin openings is configured to receive pins that hold the single metal piece in a mold tool during fabrication of the cutting tool, resulting in corresponding openings in the cutting head from being molded around the pins, which are subsequently removed.

17. A hand-held cutting tool comprising:

a handle; and a cutting head with an embedded blade including a cutting edge, the cutting head being connected to the handle, the cutting head including a channel sized to receive a workpiece therein, the embedded blade being molded or otherwise secured within the cutting head such that a portion of the cutting edge extends from the cutting head and is located and exposed within the channel for cutting the workpiece that is advanced into the channel and brought into contact with the cutting edge;

wherein the cutting head includes a hook portion at an opposite side of the channel from the handle, the hook portion including a visually distinct narrow surface section coaligned with the cutting edge;

wherein the handle includes a gripping structure including ridges extending across the handle adjacent to the cutting head; and wherein the handle further includes a cut line/guide structure parallel with the cutting edge, the cut line/guide structure being visible through openings between the ridges.

18. The hand-held cutting tool of claim 17, wherein the ridges are generally U- ped gripping ridges having beveled portions at the ends of each ridge.

19. The hand-held cutting tool of claim 17:

wherein the embedded blade consists of a single metal piece with multiple operative surface portions including the cutting edge and a tape splitter portion at an opposite side of the metal piece from the cutting edge; and wherein the embedded blade is molded or otherwise secured within the cutting head such that the tape splitter portion extends from a distal opening in the cutting head.

20. A hand-held cutting tool comprising:

a handle; and a cutting head with an embedded blade including a cutting edge, the cutting head being connected to the handle, the cutting head including a channel sized to receive a workpiece therein, the embedded blade being molded or otherwise secured within the cutting head such that a portion of the cutting edge extends from the cutting head and is located and exposed within the channel for cutting the workpiece that is advanced into the channel and brought into contact with the cutting edge;

wherein the handle includes a gripping structure including ridges extending across the handle adjacent to the cutting head; and wherein the handle further includes a cut line/guide structure parallel with the cutting edge, the cut line/guide structure being visible through openings between the ridges.

21. A hand-held cutting tool comprising:

a handle; and a cutting head with an embedded blade having multiple operative surface portions, the cutting head being connected to the handle, the embedded blade consisting of a single unitary metal piece, the multiple operative surface portions thereof including a cutting edge and a tape splitter portion, which is at an opposite side of the metal piece from the cutting edge, the cutting head including a distal opening and a channel sized to receive a workpiece therein, the embedded blade being molded or otherwise secured within the cutting head such that the tape splitter portion extends from the distal opening and a portion of the cutting edge extends from the cutting head and is located and exposed within the channel for cutting the workpiece that is advanced into the channel and brought into contact with the cutting edge;

wherein the embedded blade has a periphery boundary extending from opposite ends of the cutting edge, the periphery boundary including a curved surface section and a top flat surface section which is at the opposite side of the metal piece from the cutting edge, the curved surface section being located along the periphery boundary between the top flat surface section and the tape splitter portion; and wherein the tape splitter portion is distalmost of the multiple operative surface portions relative to the cutting edge.

22. The hand-held cutting tool of claim 21, wherein the top flat surface section is embedded within the cutting head.

23. A hand-held cutting tool comprising:

a handle; and a cutting head with an embedded blade having multiple operative surface portions, the cutting head being connected to the handle, the embedded blade consisting of a single unitary metal piece, the multiple operative surface portions thereof including a cutting edge and a tape splitter portion, which is at an opposite side of the metal piece from the cutting edge, the cutting head including a distal opening and a channel sized to receive a workpiece therein, the embedded blade being molded or otherwise secured within the cutting head such that the tape splitter portion extends from the distal opening and a portion of the cutting edge extends from the cutting head and is located and exposed within the channel for cutting the workpiece that is advanced into the channel and brought into contact with the cutting edge;

wherein the embedded blade has a periphery boundary extending from opposite ends of the cutting edge, the periphery boundary including a top flat surface section which is part of and defined by an uppermost structural reinforcing portion of the single unitary metal piece adjacent to the tape splitter portion at the opposite side of the metal piece from the cutting edge;

wherein the periphery boundary includes a flat surface section adjacent to and contiguous with the top flat surface section at an opposite end of the embedded blade from the tape splitter portion, and wherein the tape splitter portion is recessed in relation to the uppermost structural reinforcing portion relative to the cutting edge.

* * * * *